US005672468A

United States Patent [19]

Okazaki

[11] Patent Number: 5,672,468

[45] Date of Patent: Sep. 30, 1997

[54] SILVER HALIDE COLOR PHOTOGRAPHIC MATERIAL AND METHOD FOR FORMING COLOR IMAGE

[75] Inventor: Kentaro Okazaki, Kanagawa, Japan

[73] Assignee: Fuji Photo Film Col., Ltd., Minami-ashigara, Japan

[21] Appl. No.: 670,776

[22] Filed: Jun. 20, 1996

[30] Foreign Application Priority Data

Jun. 23, 1995 [JP] Japan ..... 7-179614

[51] Int. Cl.[6] ..... G03C 1/06; G03C 1/815; G03C 1/825

[52] U.S. Cl. ..... 430/522; 430/510; 430/517; 430/567; 430/599; 430/603; 430/605; 430/611; 430/613; 430/963

[58] Field of Search ..... 430/517, 522, 430/510, 567, 599, 603, 605, 963, 611, 613

[56] References Cited

U.S. PATENT DOCUMENTS 5,429,916 7/1995 Ohshima ..... 430/538

*Primary Examiner*—Geraldine Letscher
*Attorney, Agent, or Firm*—Burns, Doane, Swecker & Mathis, LLP

[57] ABSTRACT

A silver halide color photographic material having photographic constituent layers on a support, said photographic constituent layers comprising at least 3 kinds of silver halide emulsion layers different in color sensitivity and each containing a coupler producing a yellow color, a magenta color, or a cyan color and at least one light-insensitive layer, in which a silver halide emulsion contained in at least one layer of said photographic constituent layers comprises silver chloride grains or silver chlorobromide grains having a silver chloride content of 90 mol % or more sensitized by at least one compound selected from the group consisting of a gold compound, a selenium compound and a tellurium compound and at least one layer of said photographic constituent layers contains a pentamethineoxonol dye containing a substituent group at the methine chain, whereby the silver halide color photographic material exhibits excellently rapid processing performance, high purity whiteness in the white background of a finished color photograph, high sensitivity, and a small fluctuation in color forming density despite time elapsing from exposure until development when the color photographic material is exposed to light under the circumstances of high humidity.

15 Claims, No Drawings

SILVER HALIDE COLOR PHOTOGRAPHIC MATERIAL AND METHOD FOR FORMING COLOR IMAGE

FIELD OF THE INVENTION

The present invention relates to silver halide color photography, and particularly it relates to a silver halide color photographic material which exhibits excellently rapid processing performance and high sensitivity, and in addition, high purity whiteness in the white background of a finished color photograph and a small fluctuation in color forming density despite time elapsing from exposure until development when the color photographic material is exposed to light under the circumstances of high humidity; and a method for forming a color image using the same.

BACKGROUND OF THE INVENTION

A wide variety of commercially available silver halide color photographic materials and methods for forming a color image by use of these color photographic materials has been expected to be applied to various fields. Particularly, improvement in rapid processing performance of color photographic printing paper is more and more being required. The silver halide photographic materials are usually subjected to continuous processing by use of automatic processors installed in photofinishing laboratories. In recent years, as a part of services to users, processed photographic materials are generally returned to users within the date of undertaking the processing of the photographic materials. Lately, processed products including processed negative films are further required to be returned to users within one hour from undertaking the processing. Shortening of processing time makes it possible to improve production efficiency and cut costs, and therefore, it brings about great merit to the photofinishing laboratories carrying out a large amount of processing. These circumstances have prompted the development of silver halide color photographic materials suitable for rapid processing.

Further, high magnification printing using photographic printing paper of various sizes such as a panoramic size and a hivision size comes to be carried out as usage of the photographic printing paper. Exposure for such high magnification printing requires photographic materials to have high sensitivity so as not to deteriorate productivity.

In answer to a request for improvement in rapid processing performance, the so-called high silver chloride emulsions having a high content of silver chloride come to be generally used for the silver halide photographic materials. However, the silver halide emulsions having a high content of silver chloride are difficult to enhance sensitivity and to obtain hard gradation, and further, it is also known that such emulsions have disadvantages in that a change in exposure illumination causes considerable changes in sensitivity and gradation. Chemical sensitization by use of gold compounds, selenium compounds and tellurium compounds which is available for overcoming these drawbacks and promoting sensitivity enhancement is described in Canadian Patent 800,958, British Patents 1,295,462 and 1,396,696, U.S. Pat. Nos. 2,642,361 and 3,772,031, JP-B-43-13489 (The term "JP-B" as used herein means an "examined Japanese patent publication"), JP-A-4-204640 (The term "JP-A" as used herein means an "unexamined published Japanese patent application"), JP-A-4-271341, JP-A-4-333043, and so forth.

The present inventor had also examined the chemical sensitization by use of gold compounds, selenium compounds and tellurium compounds. As a result, a problem was detected. That is, although such chemical sensitization can acquire high sensitivity, exposure of the resulting photosensitive material under the circumstances of high humidity causes a large fluctuation in color forming density depending upon time elapsing from exposure until development. In view of areas, seasons, and process forms in which the processing of photographic printing paper is usually carried out, this fluctuation in color forming density is a serious problem to be solved for practical use.

As a result of intensive studies, the present inventor has found that the fluctuation in color forming density can be reduced by adding a compound selected among a group of compounds including compounds of the present invention to silver halide photographic materials. The group of compounds including compounds of the present invention was a kind of oxonol compounds which had been generally used as a water-soluble dye. However, when some compounds selected among the group of compounds were added to the photographic materials to reduce the fluctuation in color forming density, it was observed that a unexposed area, that is, a white background, was undesirably colored after being developed. As a result of further intensive studies on this problem, the present inventor has found that use of the compounds of the present invention can prevent the coloring of the white background from increasing, thus solving the problem. Furthermore, the use of the compounds of the present invention has also been found to offer the advantage of improving distinctness in addition to presenting a desired white background.

SUMMARY OF THE INVENTION

An object of the present invention is to provide a silver halide color photographic material which exhibits excellently rapid processing performance and high purity whiteness particularly in the white background of a finished color photograph, high sensitivity, and a small fluctuation in color forming density despite time elapsing from exposure until development when the color photographic material is exposed to light under the circumstances of high humidity; and a method for forming a color image using the same.

The gist of the present invention is shown by the following items (1) and (2).

(1) A silver halide color photographic material comprising a support having provided thereon photographic constituent layers comprising at least 3 kinds of silver halide emulsion layers different in color sensitivity and each containing a coupler producing a yellow color, a magenta color, or a cyan color, and at least one light-insensitive layer, in which a silver halide emulsion contained in at least one layer of said photographic constituent layers comprises silver chloride grains or silver chlorobromide grains having a silver chloride content of 90 mole % or more sensitized by at least one compound selected from the group consisting of a gold compound, a selenium compound and a tellurium compound and at least one layer of said photographic constituent layers contains at least one compound represented by the following formula (I):

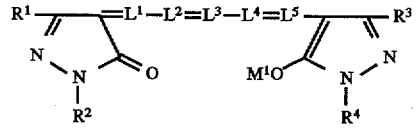

(I)

wherein $R^1$ and $R^2$ each represents an electron withdrawing group having a Hammett substituent constant $\sigma_p$ of 0.3 or more; $R^2$ and $R^4$ each represents an alkyl group or an aryl group; $L^1$ to $L^5$ each represents a methine group, with the proviso that at least one of $L^1$ and $L^5$ contains a substituent group; and $M^1$ represents a hydrogen atom, or an atomic group or metal atom to be a monovalent cation.

(2) A method for forming a color image which comprises exposing the silver halide photographic material described in the above-mentioned item (1) to light by a scanning exposure system taking a shorter exposure time than $10^{-4}$ second per pixel and then conducting color development.

DETAILED DESCRIPTION OF THE INVENTION

Examples of compounds used for gold sensitization in the present invention include chloroauric acid, potassium chloroaurate, potassium aurithiocyanate, gold sulfide, gold selenide, and gold compounds described in U.S. Pat. Nos. 2,642,361, 5,049,484 and 5,049,485.

For selenium sensitization are unstable selenium compounds can be used, which are described in JP-B-43-13489, JP-B-44-15748, JP-A-4-25832, JP-A-4-109240, JP-A-4-271341, and European Patent Publication No. 0,506,009.

Examples of these compounds include colloidal metallic selenium, selenoureas (for example, N,N-dimethylselenourea, trifluoromethylcarbonyl-trimethylselenourea and acetyl-trimethylselenourea), selenoamides (for example, selenoacetamide and N,N-diethylphenylselenoamide), phosphineselenides (for example, triphenylphosphineselenide and pentafluorophenyl-triphenylphosphineselenide), selenophosphates (for example, tri-p-tolylselenophosphate and tri-n-butylselenophosphate), selenoketones (for example, selenobenzophenone), isoselenocyanates, selenocarboxylic acids, selenoesters, and diacylselenides. Further, non-unstable selenium compounds such as selenious acid, potassium selenocyanide, selenazoles, and selenides which are described, for example, in JP-B-46-4553 and JP-B-52-34492 can also be used for this purpose.

For tellurium sensitization are unstable tellurium compounds can be used, which are described, for example, in Canadian Patent 800,958, British Patents 1,295,462 and 1,396,696, JP-A-4-204640, JP-A-4-271341, JP-A-4-333043, and JP-A-5-303157. Examples of the tellurium compounds include telluroureas (for example, tetramethyltellurourea and N,N'-dimethylethylenetellurourea), phosphinetellurides [tributylphosphinetelluride, (diisopropyl) butylphosphinetelluride, and ethoxydiphenylphosphinetelluride], diacyl(di)tellurides [for example, bis(diphenylcarbamoyl)ditelluride, bis(N-phenyl-N-methylcarbamoyl)ditelluride, bis(N-phenyl-N-methylcarbamoyl)telluride, bis(ethoxycarbonyl)telluride], isotellurocyanates telluroamides, tellurohydrazides, telluroesters (for example, Te-butyltellurobenzoate), telluroketones, colloidal tellurium, (di)tellurides, and other tellurium compounds (potassium telluride and sodium telluropentathionate).

These chemical sensitizing agents may be used singly or as mixtures of 2 or more kinds thereof, and may be preferably used together with sulfur sensitizating agents or reduction sensitizing agents. In the present invention, gold sensitization is preferred.

In the present invention, the content of gold sensitizing agent(s) is preferably from about $10^{-7}$ to about $10^{-2}$ mole per mole of silver halide. Although the contents of selenium and tellurium sensitizing agents used in the present invention varies with silver halide grains used and conditions of chemical sensitization, the respective contents are generally from about $10^{-8}$ to about $10^{-2}$ mole, and preferably from about $10^{-7}$ to about $10^{-3}$ mole per mole of silver halide.

In the present invention, although the conditions of chemical sensitization are not particularly limited, pAg is generally from 5 to 9, and preferably from 6 to 8.5; pH is preferably from 4 to 10; and the temperature is generally from 40° to 95° C., and preferably from 45° to 85° C.

The compounds represented by formula (I) of the present invention are illustrated below.

Examples of the electron withdrawing groups represented by $R^1$ and $R^3$ which have a Hammett substituent constant $\sigma_p$ of 0.3 or more (preferably 0.8 or less) include a carbamoyl group (0.36), a methylcarbamoyl group (0.36), a carboxyl group (0.45), a methoxycarbonyl group (0.45), an ethoxycarbonyl group (0.45), a methylsulfinyl group (0.49), a methylsulfonyl group (0.72), a sulfamoyl group (0.60), a benzoyl group (0.43), an acetyl group (0.50), a trifluoromethyl group (0.54), a diethylphosphono group (0.60), a cyano group (0.66), and a nitro group (0.78). The values of $\sigma_p$ are described in *Chemical Reviews*, Vol.17, pp. 125 to 136 (1935).

Groups represented by $R^1$ and $R^3$ are preferably a carboxyl group, an alkoxycarbonyl group (for example, methoxycarbonyl and ethoxycarbonyl), an acyl group (for example, acetyl and benzoyl), and a carbamoyl group (for example, carbamoyl, methylcarbamoyl and morpholinocarbamoyl). Among these, groups used particularly preferably are an alkoxycarbonyl group and a carbamoyl group. It is preferred that $R^1$ and $R^2$ are the same group.

Alkyl groups represented by $R^2$ and $R^4$ which have 1 to 8 carbon atoms and are substituted by at least one sulfo group include a sulfomethyl group, a 2-sulfoethyl group, a 3-sulfopropyl group, a 4-sulfobutyl group, and an o-sulfobenzyl group, and these groups may further contain substituent groups. Examples of the substituent groups used preferably include a halogen atom (for example, fluorine, chlorine and bromine), a hydroxyl group, a carbonyl group, a cyano group, an aryl group having 6 or 7 carbon atoms (for example, phenyl and p-tolyl), an alkoxy group having 1 to 7 carbon atoms (for example, methoxy, ethoxy and butoxy), an acyl group having 2 to 7 carbon atoms (for example, acetyl and benzoyl), an alkoxycarbonyl group having 2 to 7 carbon atoms (for example, methoxycarbonyl and ethoxycarbonyl), and an amino group having 0 to 7 carbon atoms (for example, amino, dimethylamino and diethylamino).

Aryl groups represented by $R^2$ and $R^4$ which have 6 to 10 carbon atoms and are substituted by at least one sulfo group include an o-sulfophenyl group, a m-sulfophenyl group, a p-sulfophenyl group, a 2,5-disulfophenyl group, a 3,5-disulfophenyl group, and a 4,8-disulfo-2-naphthyl group, and these groups may further contain substituent groups. Examples of the substituent groups used preferably include a halogen atom (for example, fluorine, chlorine and bromine), a hydroxyl group, a carboxyl group, a cyano group, an alkyl group having 1 to 4 carbon atoms (for example, methyl, ethyl and butyl), an alkoxy group having 1 to 4 carbon atoms (for example, methoxy, ethoxy and butoxy), an acyl group having 2 to 4 carbon atoms (for example, acetyl), an alkoxycarbonyl group having 2 to 4 carbon atoms (for example, methoxycarbonyl and ethoxycarbonyl), and an amino group having 0 to 4 carbon atoms (for example, amino, dimethylamino and diethylamino).

$R^2$ and $R^4$ are preferably phenyl groups substituted by at least one sulfo group, and more preferably phenyl groups substituted by 2 or more sulfo groups. Further, it is preferred that $R^2$ and $R^4$ are the same group.

At least one of methine groups represented by $L^1$, $L^2$, $L^3$, $L^4$, and $L^5$ contains a substituent group. Examples of the substituent groups on the methine groups include an alkyl group which has 1 to 8 carbon atoms and may further contain a substituent group, an aryl group which has 6 to 10 carbon atoms and may further contain a substituent group, an alkoxy group which has 1 to 6 carbon atoms and may further contain a substituent group (for example, methoxy and ethoxy), an alkylthio group which has 1 to 6 carbon atoms and may further contain a substituent group (for example, methylthio), an arylthio group which has 6 to 10 carbon atoms and may further contain a substituent group (for example, phenylthio), an amino group which has 0 to 8 carbon atoms and may further contain a substituent group (for example, amino and dimethylamino), a heterocyclic group which may further contain a substituent group (for example, 4-pyridyl and 1-pyrrolidinyl), a halogen atom (for example, chlorine and bromine), a hydroxyl group, a carbonyl group, a sulfo group, and a cyano group. Examples of the substituent groups linked further to these substituent groups include a heterocyclic group (for example, 4-pyridyl), in addition to substituent groups described below as groups which can link to the alkyl groups or the aryl groups specified above as the substituent groups for $L^1$ to $L^5$. Substituent groups for the methine group represented by $L^1$ to $L^5$ are preferably an alkyl group having 1 to 8 carbon atoms or an aryl group having 6 to 10 carbon atoms.

The alkyl group having 1 to 8 carbon atoms are preferably methyl, ethyl, propyl, isopropyl, butyl, t-butyl, hexyl, and octyl, and these groups may further contain substituent groups. Examples of the substituent groups used preferably include a halogen atom (for example, fluorine, chlorine and bromine), a hydroxyl group, a carboxyl group, a sulfo group, a cyano group, an aryl group having 6 or 7 carbon atoms (for example, phenyl and p-tolyl), an alkoxy group having 1 to 7 carbon atoms (for example, methoxy, ethoxy and butoxy), an acyl group having 2 to 7 carbon atoms (for example, acetyl and benzoyl), an alkoxycarbonyl group having 2 to 7 carbon atoms (for example, methoxycarbonyl and ethoxycarbonyl), and an amino group having 0 to 7 carbon atoms (for example, amino, dimethylamino and diethylamino).

The aryl groups having 6 to 10 carbon atoms are preferably a phenyl group, an 1-naphthyl group, and a 2-napthyl group, and these groups may further contain substituent groups. Examples of the substituent groups used preferably include a halogen atom (for example, fluorine, chlorine and bromine), a hydroxyl group, a carboxyl group, a sulfo group, a cyano group, an alkyl group having 1 to 4 carbon atoms (for example, methyl, ethyl and butyl), an alkoxy group having 1 to 4 carbon atoms (for example, methoxy, ethoxy and butoxy), an acyl group having 2 to 4 carbon atoms (for example, acetyl), an alkoxycarbonyl group having 2 to 4 carbon atoms (for example, methoxycarbonyl and ethoxycarbonyl), and an amino group having 0 to 4 carbon atoms (for example, amino, dimethylamino and diethylamino).

$M^1$ represents a hydrogen atom, an atomic group to be a monovalent cation (for example, ammonium, triethylammonium and pyridinium) or a metal atom to be a monovalent cation (for example, lithium, sodium and potassium), and preferably represents a hydrogen atom, sodium and potassium.

The compounds represented by formula (I) of the present invention are preferably those which are further represented by formula (II):

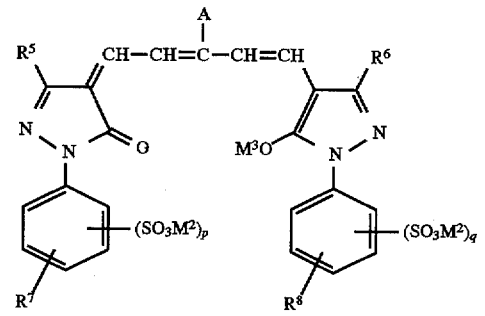

(II)

In formula (II), $R^5$ and $R^6$ are electron withdrawing groups having a Hammett substitution constant $\sigma_p$ of 0.3 to 0.6, and examples of those groups include the groups shown as $R^1$ and $R^3$ of formula (I), with the proviso that a methylsulfonyl group, a cyano group and a nitro group are excluded from the groups. The alkoxycarbonyl group (for example, methoxycarbonyl and ethoxycarbonyl) and the carbamoyl group (for example, carbamoyl and methylcarbamoyl) are particularly preferred. It is preferred that $R^5$ and $R^6$ are the same group.

$R^7$ and $R^8$ each represents a hydrogen atom, a halogen atom, a hydroxyl group, a methyl group, or a methoxy group, preferably a hydrogen atom or a methyl group, and more preferably a hydrogen atom.

A represents an alkyl group having 1 to 8 carbon atoms or an aryl group having 6 to 10 carbon atoms, and groups used preferably as A are those which are described above as substituent groups for $L^1$ to $L^5$ of formula (I).

A is preferably a substituted or a unsubstituted alkyl group having 1 to 4 carbon atoms (for example, methyl, ethyl and sulfoethyl), and more preferably a methyl group.

$M^2$ and $M^3$ each has the same meanings as $M^4$.

p and q each represents an integer of 2 to 5, preferably 2 or 3, and more preferably 2. Particularly, at least one of $SO_3M^2$ groups on the phenyl groups is preferably attached to the 2-position (ortho position) to the pyrazolone ring of formula (II).

Examples of pyrazolone-pentamethineoxonol compounds represented by formulas (I) or (II) which are used in the present invention are shown below. However, the present invention is not limited by these examples.

TABLE 1
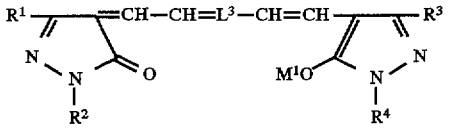
| Compound | $R^1$, $R^3$ | $R^2$, $R^4$ | $L^3$ | $M^1$ |
|---|---|---|---|---|
| D-1 | 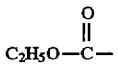 | 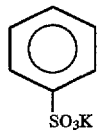 | 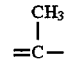 | K |
| D-2 | 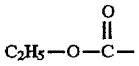 | 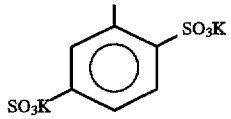 | 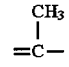 | K |
| D-3 | 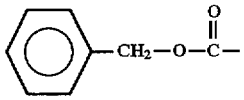 | 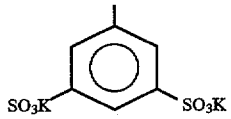 | 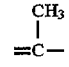 | H |
| D-4 | 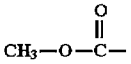 | 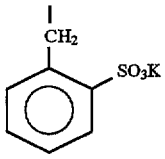 | 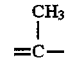 | K |
| D-5 | 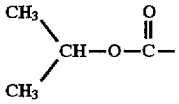 | 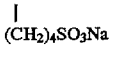 | 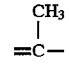 | Na |
| D-6 | 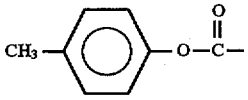 | 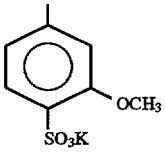 | 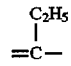 | K |
| D-7 | 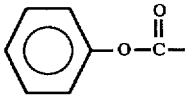 | 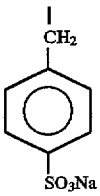 | 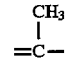 | H |
| D-8 | 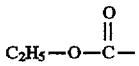 | 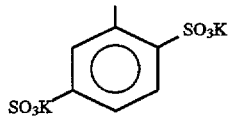 | 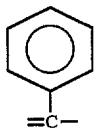 | K |
| D-9 | 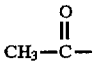 | 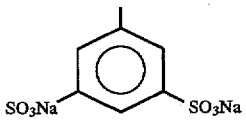 | 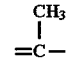 | Na |

TABLE 1-continued
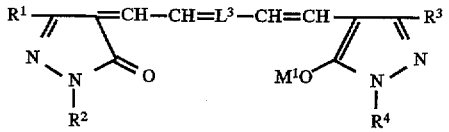
| Compound | $R^1$, $R^3$ | $R^2$, $R^4$ | $L^3$ | $M^1$ |
|---|---|---|---|---|
| D-10 | 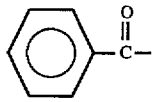 | 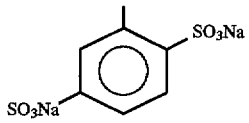 | 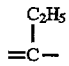 | H |
| D-11 | 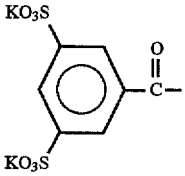 | 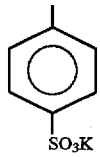 | 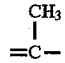 | K |
| D-12 | 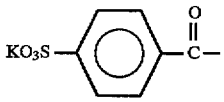 | 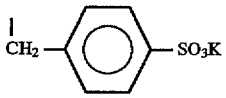 | 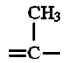 | K |
| D-13 | 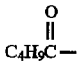 | 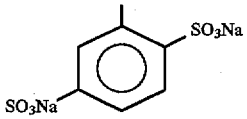 | 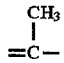 | Na |
| D-14 | 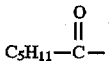 | 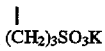 | 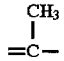 | K |
| D-15 | 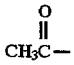 | 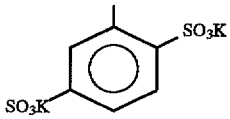 | 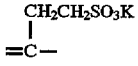 | H |
| D-16 | 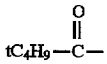 | 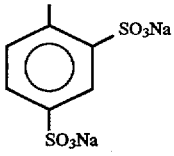 | 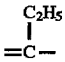 | Na |
| D-17 | 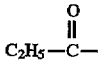 | 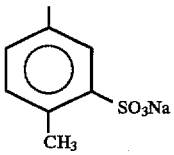 | 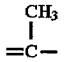 | Na |
| D-18 | KOOCC— | 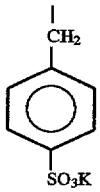 | 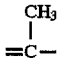 | K |
| D-19 | HOOC— | 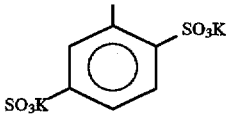 | 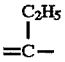 | K |

TABLE 1-continued
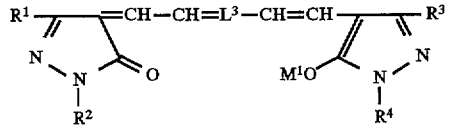
| Compound | $R^1$, $R^3$ | $R^2$, $R^4$ | $L^3$ | $M^1$ |
|---|---|---|---|---|
| D-20 | NaOOC— | 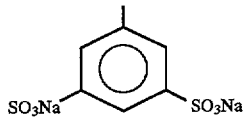 | 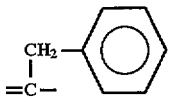 | Na |
| D-21 | 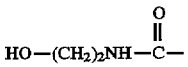 | 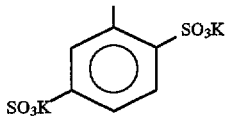 | 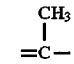 | K |
| D-22 | 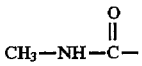 | 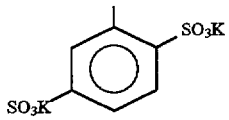 | 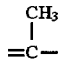 | K |
| D-23 | 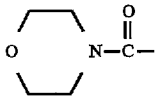 | 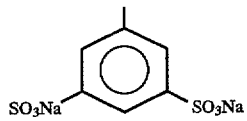 | 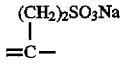 | Na |
| D-24 | 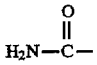 | 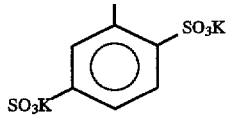 | 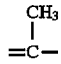 | K |
| D-25 | 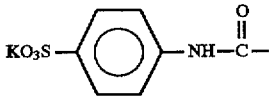 | 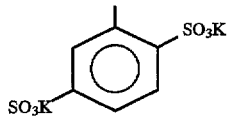 | 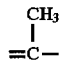 | K |
| D-26 | 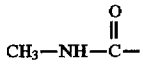 | 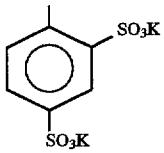 | 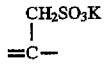 | K |
| D-27 | 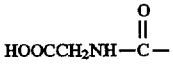 | 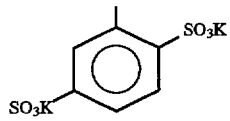 | 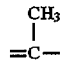 | H |
| D-28 | 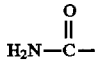 | 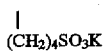 | 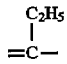 | K |
| D-29 | 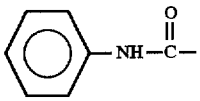 | 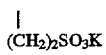 | 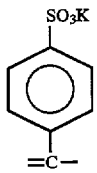 | K |
| D-30 | NC— | 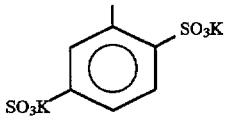 | 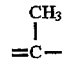 | K |

TABLE 1-continued
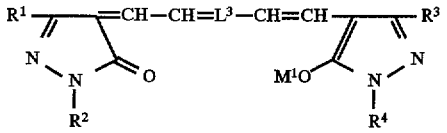
| Compound | $R^1$, $R^3$ | $R^2$, $R^4$ | $L^3$ | $M^1$ |
|---|---|---|---|---|
| D-31 | NC— | 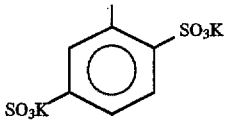 | $(CH_2)_2SO_3K$ \| =C— | H |
| D-32 | 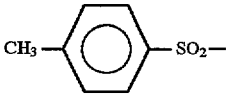 | 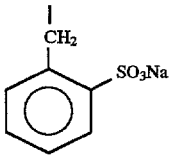 | $CH_3$ \| =C— | Na |
| D-33 | $CH_3SO_2$— | 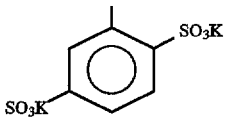 | $CH_3$ \| =C— | K |
| D-34 | 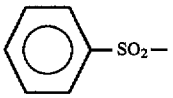 | 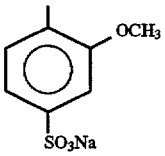 | $C_2H_5$ \| =C— | Na |
| D-35 | $C_4H_9SO_2$— | $(CH_2)_4SO_3K$ | $CH_3$ \| =C— | K |
| D-36 | $C_2H_5NH-SO_2$— | 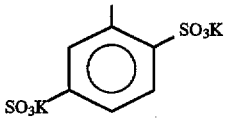 | $CH_3$ \| =C— | K |
| D-37 | $CH_3-\overset{O}{\overset{\|\|}{C}}-NH$— | 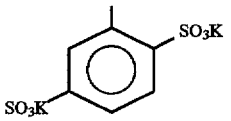 | $CH_3$ \| =C— | K |
TABLE 5
| Compound | $R^1$ | $R^3$ | $R^2$ | $R^4$ | $L^3$ | $M^1$ |
|---|---|---|---|---|---|---|
| D-38 | $CH_3SO_2$— | $H_2N-\overset{O}{\overset{\|\|}{C}}$— | 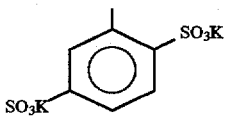 | 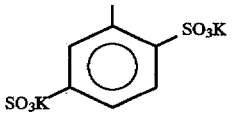 | $CH_3$ \| =C— | H |
| D-39 | $HOCH_2CH_2SO_2$— | $CH_3\overset{O}{\overset{\|\|}{C}}$— | 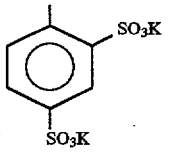 | 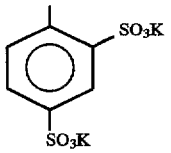 | $CH_3$ \| =C— | K |

TABLE 5-continued

| Compound | $R^1$ | $R^3$ | $R^2$ | $R^4$ | $L^3$ | $M^1$ |
|---|---|---|---|---|---|---|
| D-40 | $CH_3-NH-C(=O)-$ | $C_2H_5-O-C(=O)-$ | 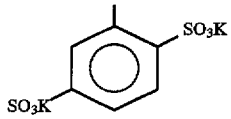 | 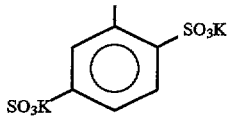 | $CH_3$ \| $=C-$ | K |
| D-41 | $C_2H_5-O-C(=O)-$ | $C_2H_5-O-C(=O)-$ | 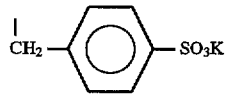 | $(CH_2)_2SO_3K$ | $(CH_2)_2SO_3K$ \| $=C-$ | K |

The compounds represented by formulas (I) and (II) can be synthesized by known methods. For example, a symmetrical oxonol compound ($R^1=R^3$, $R^2=R^4$) can be prepared, as shown below, by reacting a compound represented by formula (A) with a compound represented by formula (B) in a suitable solvent (for example, methanol, ethanol, N,N-dimethylformamide, N,N-dimethylacetamide, dimethylsulfoxide, water, or mixtures of these solvents) in the presence of a base (for example, pyridine, γ-picoline or triethylamine) and then by forming a salt with potassium acetate, sodium acetate or potassium iodide, as needed.

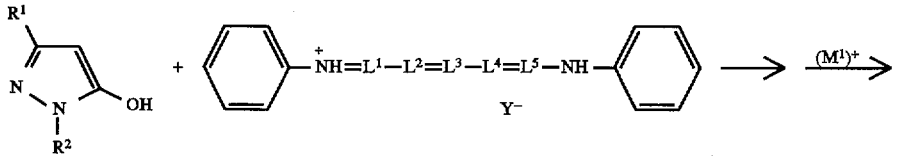

(A) (B)

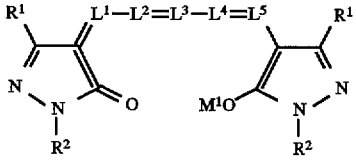

wherein $R^1$, $R^2$, $M^1$, $L^1$, $L^2$, $L^3$, $L^4$, and $L^5$ have the same meanings as those described in formula (I); Y represents an atom (for example, chlorine, bromine and iodine) or an atomic group (for example, perchlorate and p-toluenesulfonate) to be a monovalent anion.

An asymmetrical oxonol compound ($R^1 \neq R^3$ and/or $R^2 \neq R^4$) can be prepared by reacting a compound represented by formula (A) with a compound represented by formula (B) in a ratio of 1:1 and subsequently by reacting another kind of compound represented by formula (A).

The compound(s) represented by formula (I) can be added to sensitive layers and/or light-insensitive layers (e.g., interlayer, UV absorbor-containing layer, protective layer) by various known methods. To add the compounds thereto, there is a method of dispersing directly the compounds into sensitive layers or light-insensitive layers or a method of dissolving the compounds in suitable solvents (for example, methyl alcohol, ethyl alcohol, propyl alcohol, methyl cellosolve, halogenated alcohols described in JP-A-48-9715 and U.S. Pat. No. 3,756,830, acetone, water, pyridine, or mixtures of these solvents) and then adding the resulting solution to sensitive layers or light-insensitive layers. Even if these compounds are added to either sensitive layers or light-insensitive layers, the compounds almost uniformly diffuse into the whole photographic constituent layers on coating.

Although the content of the compound(s) represented by formula (I) is not particularly limited, it ranges preferably from 0.1 to 200 mg/m$^2$, and more preferably from 1 to 100 mg/m$^2$.

A preferred coating solution for adding the compound(s) represented by formula (I) is a coating solution for a light-insensitive layer rather than a silver halide emulsion layer. An example of the light-insensitive layer is an adjacent layer of the uppermost silver halide emulsion layer, which is provided at the further side from the support.

The color photographic material of the present invention is constituted of at least 3 silver halide emulsion layers formed on a support, the emulsion layers being different in color sensitivity from one another. In general color photographic printing paper, at least one layer about each of a yellow color forming silver halide emulsion layer, a magenta color forming emulsion layer, and a cyan color forming emulsion layer is formed on a support, and contains a color coupler capable of forming a dye having a color complementary to light to which the silver halide emulsion is sensitive, thus conducting color reproduction by the substractive process. In the general color photographic printing paper, the respective silver halide emulsion grains are spectrally sensitized by blue sensitive, green sensitive and red sensitive spectral sensitizing dyes in the order of the above-mentioned color forming layers, and these emulsions are applied to the support in the above-mentioned order. However, this order of the application of the emulsions is not always followed. That is, in view of the rapid processing performance, a sensitive layer containing the largest silver halide grains in average size may preferably form a top (uppermost) layer, or in view of keeping quality under light irradiation, the magenta color forming light-sensitive layer may preferably form a bottom layer.

A structure which fails to have the above-mentioned correspondence between the light-sensitive layers and the forming dyes may also be possible, and at least one infrared ray-sensitive silver halide emulsion layer may be used.

Supports usable for the present invention are transparent films such as cellulose nitrate films and poly(ethylene terephthalate) films used usually for photographic materials and reflection type supports. The transparent supports used preferably are polyesters prepared from 2,6-naphthalenedicarboxylic acid (NDCA) and ethylene glycol (EG), polyesters from NDCA, terephthalic acid and EG, and so forth, on which an information recording layer such as a magnetic layer is provided. Use of the reflective supports is more preferred for the purpose of the present invention.

The "reflective supports" used preferably in the present invention mean supports whose high reflectivity gives distinctness to dye images formed on silver halide emulsion layers. The reflective supports include those which are prepared by applying hydrophobic resins containing dispersed reflective substances such as titanium oxide, zinc oxide, calcium carbonate, and calcium sulfate to supports, and films themselves formed of hydrophobic resins containing dispersed reflective substances. There are used, for example, baryta-coated paper, polyethylene-covered paper, polyester-covered paper, polypropylene type synthetic paper, transparent supports on which reflective layers or reflective substances are provided, the transparent supports being, for example, glass plates, polyester films such as poly(ethylene terephthalate), cellulose triacetate, and cellulose nitrate, polyamide films, polycarbonate films, polystyrene films, and poly(vinyl chloride) films.

Preferred forms of the reflective supports used in the present invention are paper supports covered with water-resistant resins (for example, polyolefins and polyesters) at the both sides thereof and at least one side of the water-resistant resin layers preferably contains white pigment particles. The content of the white pigment particles is preferably 12% by weight or more, more preferably 14% by weight or more, and most preferably 20% by weight or more. It is preferred that the reflective white pigment particles are sufficiently kneaded in the resins in the presence of surfactants and that the surfaces of the pigment particles used are treated with dihydric to tetrahydric alcohols. It is not necessary for the white pigment to be uniformly dispersed into the water-resistant resin. It is advantageous that 2 or 3 layers of the water-resistant resin containing the white pigment different in content are provided on the side on which the emulsion layers are formed so as to make the white pigment content high in the water-resistant resin layer at said side. This makes it possible to reduce an amount of the white pigment to be used, thus resulting in cost reduction. Or to improve production suitability, it is also preferred that the content of the white pigment is high in intermediate water-resist resin layers consisting of 3 or more layers, whereas a water-resistant layer in close proximity to the emulsion layers is low in content of the white pigment and thin in thickness.

The white pigment particles are preferably dispersed uniformly into a reflective layer without forming the aggregates of the particles. Distribution of the particles can be determined by measuring an area ratio (%) (Ri) occupied by particles projected in a unit area. The coefficient of variation of the occupied area ratio can be determined by a ratio of the standard deviation (s) to an average value (R) of Ri (s/R). In the present invention, the coefficient of variation of the area ratio occupied by pigment particles is preferably 0.15 or less, more preferably 0.12 or less, and most preferably 0.08 or less.

Other reflection type supports used in the present invention are those which have metallic surfaces exhibiting mirror surface reflecting properties or diffused reflecting properties of the second kind. The metallic surfaces are preferably those which have a spectral reflectance of 0.5 or more in the visible wavelength region, and it is recommended to give diffused reflecting properties to metallic surfaces by surface roughening or by use of metallic powder. Examples of said metals include aluminum, tin, silver, magnesium, and their alloys, and the surfaces may be metallic plates, metallic foil, or thin metal sheets prepared by rolling, deposition, or plating. Above all, the reflection type supports used preferably are prepared by depositing a metal on another kind of substrate. The water-resistant resin layers, particularly thermoplastic resin layers, are preferably provided on the metallic surfaces. In the present invention, an antistatic layer is preferably formed on the side opposite to the metallic surface of the support. A full detail of these supports is given, for example, in JP-A-61-210346, JP-A-63-24247, JP-A-63-24251, and JP-A-63-24255. The diffused reflecting properties of the second kind mean diffused reflecting properties obtained by giving unevenness to a mirror surface to divide it into fine mirror surfaces turning to various directions, thus dispersing the direction of the finely divided mirror surface. In the uneven surface having the diffused reflecting properties, the three-dimensional average roughness to a center plane is from 0.1 to 2 μm, and preferably from 0.1 to 1.2 μm. The frequency of the uneven surfaces having roughness of 0.1 μm or more is preferably from 0.1 to 2,000 cycles/mm, and more preferably from 50 to 600 cycles/mm. Such supports are described in JP-A-2-239244 in detail.

In the present invention, a silver halide emulsion layer which is subjected to gold, selenium, or tellurium sensitization contains silver chlorobromide emulsion grains or silver chloride grains having a silver chloride content of 90 mole % or more, and not only this emulsion layer but also all sensitive silver halide emulsion layers contain silver chloride gains or silver chlorobromide grains preferably having a silver chloride content of 95 mole % or more, and more preferably 98 mole % or more. Particularly, in the present invention, silver chlorobromide or silver chloride which does not substantially contain silver iodide is preferably used to improve the processing time. The phrase. "not substantially contain silver iodide" means that the content of silver iodide is 1 mole % or less, and preferably 0.2 mole % or less. On the other hand, in some cases to improve high illumination intensity sensitivity, spectral sensitization sensitivity and aging stability, it may be preferred to use high silver chloride grains containing 0.01 to 3 mole % of silver iodide on the surface of the emulsion as described in JP-A-3-84545. The composition of halogen in the emulsions may be the same or different between grains, but use of emulsions having the same composition of halogen makes it easy to obtain uniformity of the nature of grains. From a standpoint of the distribution of the halogen composition inside silver halide emulsion grains, grains used in the present invention can be appropriately selected among grains having the so-called "structure of a uniform type" in which all portions of silver halide grains have the same composition, grains having the so-called "structure of a laminated type" in which the halogen composition of cores inside the silver halide grains is different from that of shells enclosing the cores (one layer or a plurality of layers), and grains of a structure containing portions having different halogen composition in a nonlayered state inside grains or on the surface thereof (When the portions different in halogen composition exist on the surface of grain, the grain has a structure in which the portions are jointed to the edges, corners, or surface thereof). To obtain high sensitivity, use of the latter two types of grains are more advantageous than that of the former gains having the structure of a uniform type, and also in view of pressure resistance the latter two types of grains are preferred to the former grains. When the silver halide grains have these structures, boundaries between the respective portions different in halogen composition may be distinct, or may be vague owing to formation of a mixed crystal derived from a difference in composition, or the grains may be allowed to positively have structures changed continuously.

In the high silver chloride emulsion used in the present invention, the grains preferably contain a silver bromide localized phase in the above-mentioned layered or nonlayered state inside the silver halide grains and/or on the surfaces thereof. In the halogen composition of the localized phase, the content of silver bromide preferably at least 10 mole %, and more preferable 20 mole % or more. The content of silver bromide in the silver bromide localized phase can be determined by X-ray diffractometry (for example, described *in SHIN-JIKKEN KAGAKU KOZA 6: KOZOKAISEKI* (*Lecture on New Experimental Chemistry 6: Structure Analysis*), Edited by Japan Chemical Society, Maruzen). These localized phases can exist at the edges or corners of the grain, or on the surface thereof, and one of preferred examples is a grain which attains epitaxial growth at the corners thereof.

In order to reduce a replenishment rate of a developer, it is also effective to still more increase a content of silver chloride in the silver halide emulsions. In this case, almost pure silver chloride containing 98 to 100 mole % of silver chloride is preferably used.

The average grain size of silver halide which is contained in the silver halide emulsions used in the present invention (the number average value of grain size which means a diameter of a circle equivalent to the projected area of a grain) is preferably from 0.1 to 2 μm.

About the distribution of these gain sizes, the so-called monodisperse emulsion is preferred, in which the coefficient of variation (the standard deviation of the grain size distribution divided by the average grain size) is 20% or less, preferably 15% or less, and more preferably 10% or less. Then, to obtain a broad latitude, it is also preferred that the above-mentioned monodisperse emulsion is blended in the same layer or coated in multiple layers.

The crystal forms of silver halide grains contained in the photographic emulsions are regular crystal forms such as cube, tetradecahedron and octahedron, irregular crystal forms such as globulite and plate, or composite crystal forms thereof. Further, mixtures of grains having various crystal forms may be used. In the present invention, the content of the grains having the above-mentioned regular crystal forms is 50% or more, preferably 70% or more, and most preferably. 90% or more. Emulsions which contain 50% or more of tabular grains in projected area are preferably used as well, the tabular grains having an average aspect ratio (diameter of converted circle/thickness) of 5 or more, and preferably 8 or more.

The silver chloride or chlorobromide emulsions used in the present invention can be prepared by methods described in P. Glafkides, *CHIMIE ET PHISIQUE PHOTOGRAPHIQUE*, Paul Montel, 1967; G. F. Duffin, *PHOTOGRAPHIC EMULSION CHEMISTRY*, Focal Press, 1966; V. L. Zelikman et al., *MAKING AND COATING PHOTOGRAPHIC EMULSION*, Focal Press, 1964, and the like. That is, any of an acidic method, a neutral method, an ammonia method, and so forth may be used, and any of an one-side mixing method, a simultaneous mixing method, and combined methods thereof may be used to react a soluble silver salt with a soluble halogen salt. A method for forming grains in an atmosphere of excess silver ion (the so-called reversed mixing method) can also be used. A method of keeping a constant pAg value in the liquid phase in which silver halide is formed, that is, the so-called controlled double jet method, can be used as one type of the simultaneous method. Silver halide emulsions containing grains which have regular crystal forms and almost uniform grain sizes can be prepared by this method.

In the present invention, it is preferred that a different kind of metallic ion or its complex ion is added to the localized phase of silver halide grains or its substrate. The metallic ions or complexes used preferably are selected among the ions or complexes of the metals of groups VIII and IIb in the periodic table, lead ion, and thallium ion. For the localized phase, ions or their complex ions selected among iridium, rhodium, iron, and the like can be mainly used, and for the substrate, the metallic ions or combinations thereof with metallic complex ions selected among osmium, iridium, rhodium, platinum, ruthenium, palladium, cobalt, nickel, iron, and the like can be mainly used. Metallic ions different in kind and concentration can be used for the localized phase and the substrate. A plurality of these metallic ions may be used. Particularly, it is preferred that iron and iridium compounds are allowed to exist in the silver bromide localized phase.

These metallic ion-donating compounds are contained in the localized phase of the silver halide grains and/or the other grain portion (substrate) of the present invention by dissolving silver halide grains on forming the grains in aqueous solutions of gelatin, halides, silver salts, or the like which act as a disperse medium, or by adding the compounds to the solutions in the form of silver halide containing the metallic ions beforehand.

The addition of the metallic ion used in the present invention to the emulsion grains can be carried out, either before forming the grains or immediately after forming the grains. This makes it possible to determine the sites of the grain occupied by the metallic ions. The content of these metallic ions is generally from $10^{-6}$ to $10^{-2}$ mole per mole of silver.

The emulsions used in the present invention are preferably the so-called surface latent image type emulsions in which a latent image is principally formed on the surface of grain.

To prevent the photographic material from fogging in a manufacturing process, during storage, or during photographic processing or to stabilize photographic properties, various compounds or their precursors can be added to the silver halide emulsions used in the present invention. Examples of these compounds used preferably are described in JP-A-62-215272, page 39 to page 72. Further, 5-arylamino-1,2,3,4-thiatriazole compounds (Said aryl residue contains at least one electron withdrawing group) described in European Patent 0,447,647 are preferably used as well.

The silver halide emulsions used in the present invention are generally subjected to spectral sensitization, as well as the above-mentioned chemical sensitization.

The spectral sensitization is carried out to give spectral sensitivity to each of the emulsion layers of the photographic material in a desired wavelength region.

In the photographic material of the present invention, spectral sensitizing dyes used for spectral sensitization in the blue, green and red regions are described, for example, in F. M. Hamer, *HETEROCYCLIC COMPOUNDS-CYANINE DYES AND RELATED COMPOUNDS*, John Wiley & sons, New York and London, 1964. Examples of the compounds and processes for the spectral sensitization used preferably are described in the above-mentioned JP-A-62-215272. page 22, upper right column to page 38. Particularly, in view of stability, strength of adsorption and dependence of exposure on temperature, red sensitive spectral sensitizing dyes described in JP-A-3-123340 are very preferably used for silver halide emulsion grains having a high content of silver chloride.

Spectral sensitizing dyes efficient in the infrared region, which may be preferably used for the photographic material of the present invention, are described in JP-A-3-15049, page 12, upper left column to page 21, lower left column; JP-A-3-20730, page 4, lower left column to page 15, lower left column; European Patent 0,420,011, page 4, line 21 to page 6, line 54; European Patent 0,420,012, page 4, line 12 to page 10, line 33; European Patent 0,443,466; and U.S. Pat. No. 4,975,362.

To add these spectral sensitizing dyes to the silver halide emulsions, the dyes may be directly dispersed into the emulsions, or after the dyes are dissolved in solvents such as water, methanol, ethanol, propanol, methyl cellosolve, 2,2,3,3-tetrafluoropropanol, or mixed solvents, the resulting solution may be added to the emulsions. Further, solutions of the spectral sensitizing dyes prepared in the presence of acids or bases as described in JP-B-44-23389, JP-B-44-27555 and JP-B-57-22089 or solutions or dispersions of the dyes prepared in the presence of surfactants as described in U.S. Pat. Nos. 3,822,135 and 4,006,025 may be added to the emulsions. Furthermore, after the spectral sensitizing dyes are dissolved in solvents such as phenoxyethahol which are substantially unmiscible with water, the resulting solutions are dispersed in water or hydrophilic colloids, and the resulting dispersions may then be added to the emulsions. The spectral sensitizing dyes are directly dispersed in hydrophilic colloids, and the resulting dispersions may then be added to the emulsions as described in JP-A-53-102733 and JP-A-58-105141. The addition of the spectral sensitizing dyes to the emulsions may be conducted at any steps in an emulsion preparing process which are known to be effective. That is, the time for adding the dyes to the emulsions is possible at any step of the following; before the formation of gains of silver halide emulsions, during the formation of grains, at the interval of from immediately after the formation of grains till the water-washing step, before the chemical sensitization, during the chemical sensitization, at the interval of from just after the chemical sensitization till freezing of the emulsions, or on preparing coating solutions. The addition of the spectral sensitizing dyes to the emulsions is more usually carried out at the interval of from completing the chemical sensitization till coating. However, it is also possible to simultaneously conduct the spectral sensitization and the chemical sensitization by adding the spectral sensitizing dyes and chemical sensitizing agents to the emulsions at the same time as described in U.S. Pat. No. 3,628,969 and 4,225,666; to conduct the spectral sensitization prior to the chemical sensitization as described in JP-A-58-113928; or to start the spectral sensitization by adding the dyes to the emulsions before completing the precipitation of silver halide grains. Further, divided addition of the spectral sensitizing dyes as described in U.S. Pat. No. 4,225,666 is also possible, in which a portion of the dyes is added prior to the chemical sensitization, and the residual portion of the dyes is added after the chemical sensitization. The addition of the spectral sensitizing dyes may be conducted at any steps of the formation of silver halide grains, the methods including ones described in U.S. Pat. No. 4,183,756. Among these steps, the sensitizing dyes are preferably added before the water-washing step of the emulsions or before the chemical sensitization.

Although the content of these spectral sensitizing dyes widely varies as needed, it ranges preferably from $0.5\times10^{-6}$ to $1.0\times10^{-2}$ mole, and more preferably from $1.0\times10^{-6}$ to $5.0\times10^{-3}$ mole per mole of silver halide.

In the present invention, when sensitizing dyes having spectral sensitizing sensitivity in the red to infrared region are used, the dyes are preferably used together with compounds described in JP-A-2-157749, page 13, lower right column to page 22, lower right column. Use of these compounds makes it possible to specifically improve the storability, the processing stability and the supersensitization effect of the photographic material. Among these compounds, compounds represented by formulas (IV), (V) and (VI) described in the above-mentioned specification are particularly preferably used together with the sensitizing dyes. The content of these compounds per mole of silver halide ranges from $0.5\times10^{-5}$ to $5.0\times10^{-2}$ mole, and preferably from $5.0\times10^{-5}$ to $5.0\times10^{-3}$ mole, and it is advantageous that the content of the compounds per mole of the sensitizing dyes ranges from 0.1 to 10,000 times, and preferably from 0.5 to 5,000 times.

Although the photographic material of the present invention is used for a printing system using a usual negative printer, it is preferably used for digital scanning exposure using monochromatic high density light such as gas lasers, light emitting diodes, semiconductor lasers, and second higher harmonic generating sources obtained by combining the semiconductor lasers or solid state lasers using the semiconductor lasers as excitation sources with nonlinear optical crystals. To obtain a compact and inexpensive system, the semiconductor lasers or the second higher harmonic generating sources obtained by combining the semiconductors lasers or the solid state lasers with the nonlinear optical crystals are preferably used. Particularly, to design compact, inexpensive devices which have a long life and high stability, it is preferred that the semiconductor lasers are used or at least one of exposure sources is the semiconductor laser.

When such scanning exposure light sources are used, spectral sensitivity maximums of the photographic material of the present invention can be appropriately adjusted according to the wavelengths of the scanning exposure sources used. In the solid state lasers using the semiconductor lasers as the excitation sources or the second higher harmonic generating sources obtained by combining the semiconductor lasers with the nonlinear optical crystals, the oscillating wavelengths can be halved to obtain blue color light and green color light. The photographic material can have the spectral sensitivity maximums in the usual blue, green and red regions. When the semiconductor lasers are used as light sources to obtain inexpensive, highly stable, and compact devices, at least two layers preferably have spectral sensitivity maximums in the 670 nm or more region. The reason for this is that the emission wavelengths of the available, inexpensive, stable semiconductor lasers of the groups III to V series are now only in the red to infrared regions. However, oscillation of semiconductor lasers of the groups II to VI series was experimentally found to be in the green and blue regions, and therefore it is fully expected that advance in manufacturing technique of the semiconductor lasers would make it possible to use inexpensively and stably these semiconductor lasers. In such cases, it would not be necessary for at least two layers to have the spectral sensitivity maximums in the 670 or more region.

In such scanning exposure, the time taken to expose silver halide in the photographic material to light equals the time required to expose a minute area to light. The minimum unit for controlling the quantity of light according to the respective digital data is generally used as the minute area, and is referred to as a pixel. The exposure time per pixel accordingly varies with an area of the pixel. The area of the pixel depends on pixel density, but practically ranges from 50 to 2,000 dpi. When the exposure time is defined as the time taken to expose a pixel size having a pixel density of 400 dpi to light, the exposure time is preferably $10^{-4}$ second or less, and more preferably $10^{-6}$ second or less.

In the photographic material of the present invention, to prevent the material from irradiation or halation and to improve safelight safety, dyes (particularly, oxonol dyes or cyanine dyes) capable of color removal by a treatment described in European Patent 0.337,490A2, page 27 to 76 can be added to the hydrophilic colloidal layer. In some of these water-soluble dyes, increase in amount of the dyes used may cause deterioration in color separation and safelight safety. The water-soluble dyes which can be preferably used without deteriorating the color separation are described in European Patent 0,539,978, JP-A-5-127325, and JP-A-5-127324.

In the photographic material of the present invention, a coloring layer capable of color removal by a treatment can be provided with the use of the water-soluble dyes. The coloring layer may be formed in contact with an emulsion layer, either directly or via an intermediate layer containing a color mixture preventive such as gelatin or hydroquinone. The coloring layer may be preferably formed as a underlayer (a support side) for an emulsion generating a primary color similar to that of the coloring layer. It is also possible, either to provide all coloring layers corresponding to the respective primary colors or to provide coloring layers selected appropriately. Further, a coloring layer colored according to a plurality of primary color regions can also be formed. The highest optical reflection density of the coloring layer in the wavelength regions used for exposure (in exposure using the usual printer, the 400 to 700 nm visible ray region; in the scanning exposure, the wavelengths of scanning exposure sources used) is preferably from 0.2 to 3.0, more preferably from 0.5 to 2.5, and most preferably from 0.8 to 2.0.

To form a coloring layer, known methods can be adopted. Examples of the methods include a method of adding solid fine particles such as dyes described in JP-A-2-282244, page 3, upper right column to page 8 and dyes described in JP-A-3-7931, page 3, upper right column to page 11, lower left column in a dispersion state to a hydrophilic colloidal layer; a method of mordanting a cationic polymer by an anionic dye; a method of adsorbing a dye by fine particles such as silver halide to fix it in a layer; and a method using colloidal silver as described in JP-A-1-239544. To disperse fine particles of a dye in a solid state, a method of adding the fine particles which are substantially water-insoluble at least at pH 6 or less and substantially water-soluble at least at pH 8 or more is described in JP-A-2-308244, page 4 to page 13.

In the photographic material of the present invention, gelatin is advantageously used as a binder or a protective colloid. However, other hydrophilic colloids can be also used, singly or together with gelatin. Gelatin used preferably is low calcium gelatin in which the calcium content is 800 ppm or less, and more preferably 200 ppm or less. To inhibit propagation of various kinds of mold and bacteria in hydrophilic layers, which result in deterioration in image, antifungal agents as described in JP-A-63-271247 are preferably added.

When the photographic material of the present invention is subjected to printer exposure, use of a band stop filter described in U.S. Pat. No. 4,880,726 is preferred. This excludes light color amalgamation to markedly improve color reproduction.

An exposed photographic material can be subjected to customary color development. In view of the rapid processing performance, the color photographic material of the present invention is preferably subjected to bleach-fix after the color development. Particularly, when the above-mentioned high silver chloride emulsions are used, a bleach-fix bath is preferably adjusted to pH about 6.5 or less, and more preferably to pH about 6 or less for the promotion of silver removal.

In the present invention, the processing time of the silver halide photographic material is generally from 10 seconds to 2 minutes, and preferably from 15 seconds to 1 minute. In view of the environmental protection, the replenishment rate of a color developer is preferably as small as possible. The replenishment rate per $m^2$ of the photographic material is preferably 100 ml or less, and particularly preferably 50 ml or less to display more markedly the effect of the present invention. Although a lower replenishment rate is preferred, the lower limit thereof is suitably 30 ml or more for the purpose of avoiding fluctuation in photographic properties.

The silver halide emulsions and other materials (for example, additives), photographic constituent layers (for example, layer arrangement), and processing methods and additives for processing which are preferably used in the photographic material of the present invention are described in specifications shown in the following table 6, particularly European Patent 0,355,660A2 (JP-A-2-139544), in addition to the above.

TABLE 6-1

| Photographic Constituent Element | JP-A-62-215272 | JP-A-2-33144 | EP-0, 355, 660A2 |
|---|---|---|---|
| Silver Halide Emulsions | page 10, upper right column, line 6 to page 12, lower left column, line 5; and page 12, lower right column, line 4 from the bottom to page 13, upper left column, line 17 | page 28, upper right column, line 16 to page 29, lower right column, line 11; and line 5 | page 45, line 53 to page 47, line 3; and page 47, line 20 to line 22 |

TABLE 6-1-continued

| Photographic Constituent Element | JP-A-62-215272 | JP-A-2-33144 | EP-0, 355, 660A2 |
|---|---|---|---|
| Silver Halide Solvents | page 12, lower left column, line 6 to line 14; and page 13, upper left column, line 3 from the bottom to Page 18, lower left column, the last line | — | — |
| Chemical Sensitizers | page 12, lower left column, line 3 from the bottom to lower right column, line 5 from the bottom; and page 18, lower right column, line 1 to page 22, upper right column, line 9 from the bottom. | page 29, lower right column, line 12 to the last line. | page 47, line 4 to line 9 |
| Spectral Sensitizers (Methods for Spectral Sensitization) | page 22, upper right column, line 8 from the bottom to page 38, the last line | page 30, upper left column, line 1 to line 13 | page 47, line 10 to line 15 |
| Emulsion Stabilizers | page 39, upper left column, line 1 to page 72, upper right column, the last line | page 30, upper left column, line 14 to upper right column, line 1 | page 47, line 16 to line 19 |
| Development Accelerators | page 72, lower left column, line 1, to page 91, upper right column, line 3 | — | — |
| Color Couplers (Cyan, Magenta, and Yellow Couplers Used Together with the Former Two Couplers) | page 91, upper right column, line 4 to page 121, upper left column, line 6 | page 3, upper right column, line 14 to page 18, upper left column, the last line; and page 30, upper right column, line 6 to page 35, lower right column, line 11 | page 4, line 15 to line 27; page 5, line 30 to page 28, the last line; page 45, line 29 to line 31; and page 47, line 23 to page 63, line 50 |
| Color Generation Boosters | page 121, upper left column, line 7 to page 125, upper right column, line 1 | — | — |
| Ultraviolet Absorbers | page 125, upper right column, line 2 to page 127, lower left column, the last line | page 37, lower right column, line 14 to page 38, upper left column, line 11 | page 65, line 22 to line 31 |
| Discoloration Preventives (Image Stabilizers) | page 127, lower right column, line 1 to page 137, lower left column, line 8 | page 36, upper right column, line 12 to page 37, upper left column, line 19 | page 4, line 30 to page 5, line 23; page 29, line 1 to page 45, line 25; page 45, line 33 to line 40; and page 65, line 2 to line 21 |
| High- and/or Low-Boiling Organic Solvents | page 137, lower left column, line 9 to page 144, upper right column, the last line | page 35, lower right column, line 14 to page 36, upper left column, line 4 from the bottom | page 64, line 1 to line 51 |
| Methods for Dispersing Photographic Additives | page 144, lower left column, line 1 to page 146, upper right column, line 7 | page 27, lower right column, line 10 to page 28, upper left column, the last line; and page 35, lower right column, line 12 to page 36, upper right column, line 7 | page 63, line 51 to page 64, line 56 |
| Hardening Agents | page 146, upper right column, line 8 to page 155, lower left column, line 4 | — | — |
| Precursors of Developers | page 155, lower left column, line 5 to page 155, lower right column, line 2 | — | — |
| Development Inhibitor-Releasing Compound | page 155, lower right column, line 3 to line 9 | — | — |
| Layer Structure of Photographic Material | page 156, upper left column, line 15 to page 156, lower right column, line 14 | page 28, upper right column, line 1 to line 15 | page 45, line 41 line 52 |
| Dyes | page 156, lower right column, line 15 to page 184, lower right column, the last line | page 38, upper left column, line 12 to upper right column, line 7 | page 66, line 18 to line 22 |

TABLE 6-1-continued

| Photographic Constituent Element | JP-A-62-215272 | JP-A-2-33144 | EP-0, 355, 660A2 |
|---|---|---|---|
| Color Mixture Preventives | page 185, upper left column, line 1 to page 188, lower right column, line 3 | page 36, upper right column, line 8 to line 11 | page 64, line 57 to page 65, line 1 |
| Gradation Adjusters | page 188, lower right column, line 4 to line 8 | — | — |
| Stain Inhibitors | page 188, lower right column, line 9 to page 193, lower right column, line 10 | page 37, upper left column, the last line to lower right column, line 13 | page 65, line 32 to page 66, line 17 |
| Surfactants | page 201, lower left column, line 1 to page 210, upper right column, the last line | page 18, upper right column, line 1 to page 24, lower right column, the last line; and page 27, lower left column, line 10 from the bottom to lower right column, line 9 | — |
| Fluorine-Containing Compounds*1 | page 210, lower left column, line 1 to page 222, lower left column, line 5 | page 25, upper left column, line 1 to page 27, lower right column, line 9 | — |
| Binders (Hydrophilic colloid) | page 222, lower left column, line 6 to page 225, upper left column, line 2 | page 38, upper right column, line 8 to line 18 | page 66, line 23 to line 28 |
| Viscosity Enhancement Agents | page 225, upper right column, line 1 to page 227, upper right column, line 2 | — | — |
| Antistatic Agents | page 227, upper right column, line 3 to page 230, upper left column, line 1 | — | — |
| Polymer Latexes | page 230, upper left column, line 2 to, page 239, the last line | — | — |
| Matting Agents | page 240, upper left column, line 1 to page 240, upper right column, the last line | — | — |
| Methods for Photographic Processing*2 | page 3, upper right column, line 7 to page 10, upper right column, line 5 | page 39, upper left column, line 4 to page 42, upper left column, the last line | page 67, line 14 to page 69, line 28 |

*1 Used as antistatic agents, coating additives, lubricants, anti-blocking agents, and so forth.
*2 processing steps, additives, and so forth.
Remarks: The cited portions of JP-A-62-215272 include the contents amended by the Amendment dated March 16, 1987.

It is preferred that cyan, magenta, or yellow couplers are incorporated in loadable latex polymers (for example, U.S. Pat. No. 4,203,716) in the presence or absence of high-boiling organic solvents described in the above-mentioned table, or dissolved therein together with water-insoluble, organic solvent-soluble polymers to emulsify and disperse in aqueous solutions of hydrophilic colloids.

The water-insoluble, organic solvent-soluble polymers used preferably are homopolymers or copolymers described in U.S. Pat. No. 4,857,449, column 7 to 15; and International Publication No. WO88/00723, page 12 to 30. Use of methacrylate type or acrylamide type polymers, particularly acrylamide type polymers, are more preferred in view of color image stability.

In the photographic material of the present invention, color image keeping quality improvers as described in European Patent 0,277,589A2 are preferably used together with couplers. It is particularly preferred that the improvers are used together with pyrazoloazole couplers, pyrrolotriazole couplers, acylacetamide type yellow couplers.

That is, compounds described in the above-mentioned European Patent which form chemically inactive, substantially colorless compounds by reacting with aromatic amine type developing agents remaining after color development and/or compounds described in the above-mentioned European Patent which form chemically inactive, substantially colorless compounds by reacting with the oxidized formes of the aromatic amine type color developing agents are preferably used singly or simultaneously to avoid stain generation owing to the formation of dyes which takes place by the reaction of couplers with the color developing agents remaining in film after processing during storage, and other side reactions.

Examples of the cyan couplers used preferably include, in addition to phenol type couplers and naphthol type couplers as described in the specifications of the above-mentioned table, diphenylimidazole type cyan couplers described in JP-A-2-33144, 3-hydroxypyridine type cyan couplers described in European Patent 0,333,185A2, cyclic active methylene type cyan couplers described in JP-A-64-32260, pyrrolopyrazole type cyan couplers described in European Patent 0,456,226A1, pyrroloimidazole type cyan couplers described in European Patent 0,484,909, and pyrrolotriazole type cyan couplers described in European Patents 0,488,248 and 0,491,197A1. Among these, use of pyrrolotriazole type cyan couplers is particularly preferred.

An example of magenta couplers is 5-pyrazolone type magenta couplers as described in the specifications of the above-mentioned table. Arylthio-eliminated 5-pyrazolone type magenta couplers described in International Publication Nos. WO92/18901, WO92/18902 and WO92/18903 are preferably used as the 5-pyrazolone type magenta couplers, in view of image keeping quality and fluctuation in image quality due to processing.

Known pyrazoloazole type couplers are used in the present invention. However, from the standpoint of hue, image stability and color generation properties, the pyrazoloazole type couplers used preferably among these couplers include pyrazolotriazole couplers to which a secondary or tertiary alkyl group directly links at the 2-, 3- or 6-position as described in JP-A-61-65245; pyrazoloazole couplers containing a sulfonamido group in molecule as described in JP-A-61-65246; pyrazoloazole couplers containing an alkoxyphenyl-sulfonamido ballasting group as described in JP-A-61-147254; and pyrazoloazole couplers containing an alkoxy group or an aryloxy group at the 6-position as described in European Patents 226,849A and 294,785A.

Yellow couplers used preferably are known acylacetanilide type couplers, and above all, pivaloylacetanilide type couplers containing a halogen atom or an alkoxy group at the ortho position of the aniline ring; acylacetanilide type couplers described in European Patent 0,447,969A, JP-A-5-107701, JP-A-5-113642, and so forth, the acyl group being a cycloalkanecarbonyl group substituted at the 1-position; and malondianilide type couplers described in European Patents 0,482,552A and 0,524,540A, and so forth.

Methods for the processing of the color photographic material and processing materials used preferably in the present invention include those which are described in JP-2-207250, page 26, lower right column, line 1 to page 34, upper right column, line 9 and JP-A-4-97355, page 5, upper left column, line 17 to page 18, lower right column, line 20, as well as the methods shown in the above-mentioned table.

The present invention is illustrated below with reference to examples in detail. However, the present invention is not limited by these examples.

EXAMPLE 1

Preparation of Emulsion R-101L (Red Sensitive Large Size Emulsion):

After 25 g of gelatin treated with lime was dissolved in 650 cc of distilled water at 40° C., 3.25 g of sodium chloride was added to the solution, and the temperature was raised to 60° C. Subsequently, a solution of 5.0 g of silver nitrate in 140 cc of distilled water and a solution of 1.7 g of sodium chloride in 140 cc of distilled water were added to the above-mentioned solution maintained at 60° C. with stirring over a 6-minute period. A solution of 57.5 g of silver nitrate in 160 cc of distilled water and a solution of 19.8 g of sodium chloride in 160 cc of distilled water were then added to the resulting mixture maintained at 60° C. with stirring over a 40-minute period.

Further, a solution of 62.5 g of silver nitrate in 160 cc of distilled water and a solution of 21.5 g of sodium chloride and 4.5 mg of potassium ferrocyanide in 160 cc of distilled water were added to the resulting mixture maintained at 60° C. with stirring over a 40-minute period.

After the mixture was subjected to salt removal and washing with water, 76.0 g of gelatin treated with lime was added thereto, and further, the mixture was adjusted to pAg 7.9 and to pH 6.2 with sodium chloride and sodium hydroxide.

After the temperature was raised to 50° C., sensitizing dye G and sensitizing dye H were added in amounts of $4.0\times10^{-5}$ mole and $5.0\times10^{-5}$ mole per mole of silver halide, respectively. Further, after an emulsion of fine silver bromide grains having a size of 0.05 μm was added so that the amount of silver bromide can be $5\times10^{-5}$ mole per mole of silver halide, the resulting mixture was most suitably subjected to sulfur sensitization by use of triethylthiourea. The silver chloride emulsion thus prepared was defined as emulsion R-101L. Further, potassium hexachloroiridate (IV) was added to silver bromide grains so as to be $4\times10^{-7}$ mole per mole of silver halide.

About emulsion R-101L, shapes of the grains, grain sizes and the distribution of grain sizes were determined with the aid of electron microscopic photographs. The grain sizes were represented by an average value of diameters of circles equivalent to the projected areas of the grains, and the distribution of grain sizes was represented by the standard deviation of grain diameters divided by the average grain size. The grains were cubic grains with pointed corners, having a grain size of 0.55 μm and distribution of grain sizes of 0.10.

Preparation of Emulsion R-101S (Red Sensitive Small Size Emulsion:

To obtain a small size emulsion, a lower temperature than that in the preparation of emulsion R-101L was used, and sensitizing dye G and sensitizing dye H were added in respective amounts of $5.0\times10^{-5}$ mole and $6.0\times10^{-5}$ mole per mole of silver halide, respectively, thus preparing emulsion R-101S. The average grain size was 0.45 μm and the distribution of grain sizes was 0.11.

Emulsions R102 to R122 (having L-series and S-series, respectively) were similarly prepared, except that the emulsions were most suitably subjected to chemical sensitization by use of sensitizers shown in Table 7 in place of triethylthiourea used in R-101L and R-101S. L-series and S-series of these emulsions had the same average grain size and distribution of grain sizes as those of R101L and R101S, respectively.

Gold Sensitizer $KAuCl_4$ (α-1)

$Au_2S$ (α-2)

Selenium Sensitizer (β-1)

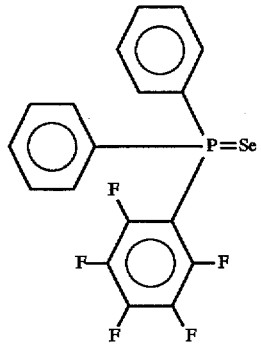

(β-2)

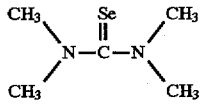

Tellurium Sensitizers (γ-1)

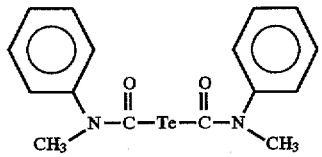

-continued (γ-2)

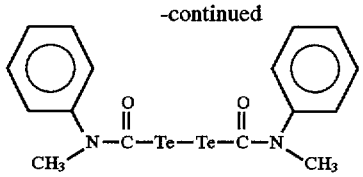

Preparation of Photographic Material 101:

After a paper support to which polyethylene was laminated on both the sides thereof was subjected to corona discharge treatment, a gelatin undercoat layer containing sodium dodecybenzenesulfonate was provided on the support, and further, various photographic constituent layers were formed on the support to prepare multilayer color photographic printing paper (101) having the following layer structure. Coating solutions were prepared as followed.

Preparation of Coating Solution for the First Layer:

A solution, which was prepared by dissolving 122.0 g of yellow coupler (ExY), 15.4 g of color image stabilizer (Cpd-1), 7.5 g of color image stabilizer (Cpd-2), 16.7 g of color image stabilizer (Cpd-3), and 1.5 g of color image stabilizer (Cpd-5) in 20 g of solvent (Solv-1), 20 g of solvent (Solv-5) and 180 cc of ethyl acetate, was emulsified and dispersed in 1,000 g of a 10% aqueous solution of gelatin containing 86 cc of 10% sodium dodecylbenzenesulfonate to prepare emulsified dispersion A. On the other hand, silver chlorobromide emulsion A was prepared (cubes; a 3:7 (molar ratio of silver) mixture of large size emulsion A having an average grain size of 0.88 μm and small size emulsion A having an average grain size of 0.70 μm; The respective coefficients of variation in the distribution of grain sizes were 0.08 and 0.10; In each of the large and small size emulsions, 0.3 mole % of silver bromide was localized on part of the surfaces of the grains containing silver chloride as a base material). The above-mentioned emulsified dispersion A was mixed with the silver chlorobromide emulsion A, and dissolved to prepare the coating solution for the first layer so as to have the composition shown below. The coating amount of the emulsion is represented by a value converted to silver amount.

Coating solutions for the second to seventh layers were prepared by a similar method to that of the coating solution for the first layer. The gelatin hardener used for each of the layers was a sodium salt of 1-oxy-3,5-dichloro-s-triazine. Cpd-12 and Cpd-13 were added to each of the layers so as to be 25.0 mg/m$^2$ and 50.0 mg/m$^2$ in total amounts, respectively.

Silver chlorobromide emulsions for a blue sensitive emulsion layer and a green sensitive emulsion layer were prepared by a similar method to that for the preparation of the above-mentioned silver chlorobromide emulsion R-101. After the following spectral sensitizing dyes were added, respectively, the emulsions were most suitably to subjected to chemical sensitization by use of adjusted amounts of triethylthiourea and chloroauric acid.

Sensitizing Dyes for Blue Sensitive Emulsion Layer:

Sensitizing Dye A

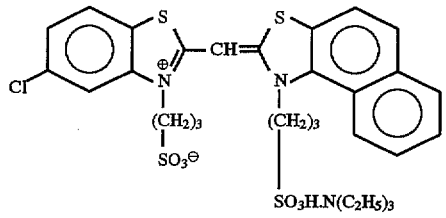

Sensitizing Dye B

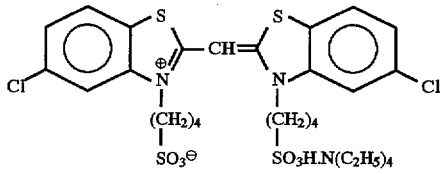

Sensitizing Dye C

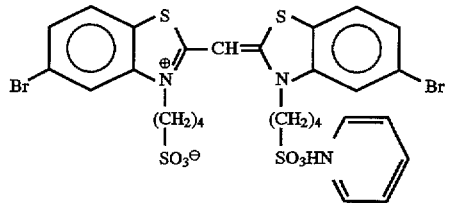

These dyes were used in an amount of $1.4\times10^{-4}$ mole per mole silver halide for each of the large size emulsions and $1.7\times10^{-4}$ mole for each of the small size emulsions.

Sensitizing Dyes for Green Sensitive Emulsion Layers:

Sensitizing Dye D

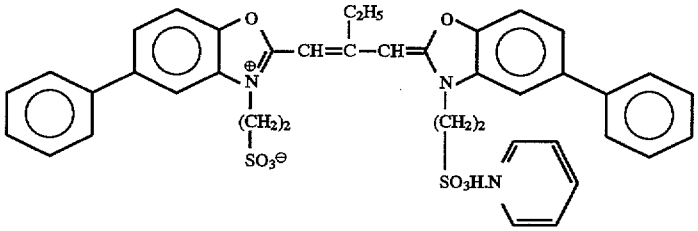

-continued

Sensitizing Dyes for Green Sensitive Emulsion Layers:

Sensitizing Dye E

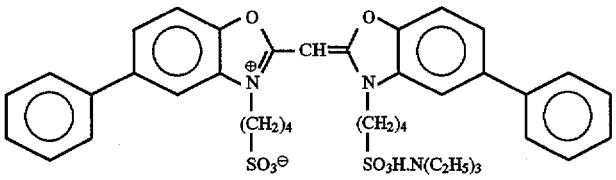

Sensitizing Dye F

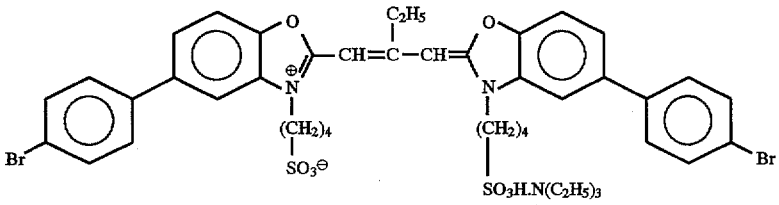

The amounts of these sensitizing dyes used per mole of silver halide were as follows: sensitizing dye D $3.0\times10^{-4}$ mole for the large size emulsions and $3.6\times10^{-4}$ mole for the small size emulsions; sensitizing dye E $4.0\times10^{-5}$ mole for the large size emulsions and $7.0\times10^{-5}$ mole for the small size emulsions; and sensitizing dye F $2.0\times10^{-4}$ mole for the large size emulsions and $2.8\times10^{-4}$ mole for the small size emulsions.

Sensitizing Dyes for Red Sensitive Emulsion Layers:

Sensitizing Dye G

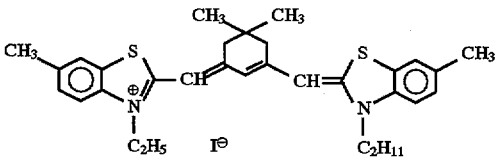

Sensitizing Dye H

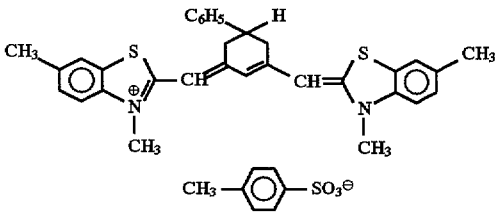

The following compound was further added in an amount of $2.6\times10^{-3}$ mole per mole of silver halide to the red sensitive silver halide emulsions.

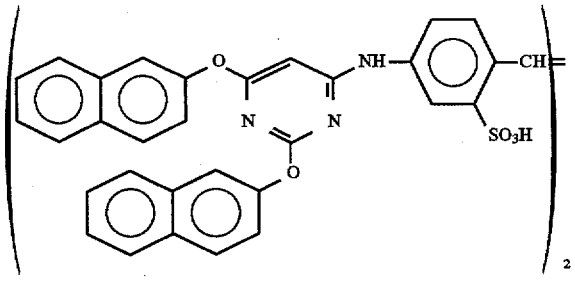

To the blue sensitive emulsions, the green sensitive emulsions and the red sensitive emulsions, 1-(5-methylureidophenyl)-5-mercaptotetrazole was added in amounts of 8.5×10–4 mole, 3.0×10–3 mole and 2.5×10–4 mole per mole of silver halide, respectively.

Further, to the blue sensitive emulsions and the green sensitive emulsions, 4-hydroxy-6-methyl-1,3,3a,7-tetrazaindene was added in amounts of $1\times10^{-4}$ mole and $2\times10^{-4}$ mole per mole of silver halide, respectively.

Layer Structure:

The compositions of the respective layers are shown below. The numbers therein represent coating amounts ($g/m^2$). The coating amounts of silver halide emulsions are represented by values converted to amounts of silver.

Support (A):

A resin layer at the first layer side contains a blue-tinged dye (ultramarine).

The First Layer (Blue Sensitive Emulsion Layer):

Silver Chlorobromide Emulsion A-1 0.27 (cubes; a 2:8 (molar ratio of silver) mixture of a large size emulsion having an average grain size of 0.89 μm and a small size emulsion having an average grain size of 0.71 μm; The respective coefficients of variation in the distribution of grain sizes are 0.08 and 0.10; In each of the large and small size emulsions, 0.3 mole % of silver bromide was localized on part of the surfaces of grains containing silver chloride as a base material; Inside the grains and in the layers in which silver bromide was localized, potassium hexachloroiridate (IV) and potassium ferrocyanide were added in amounts of 0.1 mg and 1.0 mg in total, respectively.)

Gelatin 1.22
Yellow Coupler (ExY) 0.79
Color Image Stabilizer (Cpd-1) 0.08
Color Image Stabilizer (Cpd-2) 0.04
Color Image Stabilizer (Cpd-3) 0.08
Color Image Stabilizer (Cpd-5) 0.01
Solvent (Solv-1) 0.13
Solvent (Solv-5) 0.13

The Second Layer (Color Mixture Prevention Layer):

Gelatin 0.90
Color Mixture Preventive (Cpd-4) 0.08
Solvent (Solv-1) 0.10
Solvent (Solv-2) 0.15
Solvent (Solv-3) 0.25
Solvent (Solv-8) 0.03

The Third Layer (Green Sensitive Emulsion Layer):

Silver Chlorobromide Emulsion 0.13

(cubes; a 1:3 (molar ratio of silver) mixture of a large size emulsion having an average grain size of 0.55 μm and a small size emulsion having an average grain size of 0.39 μm; The respective coefficients of variation in the distribution of grain sizes are 0.08 and 0.06; To each of the large and small size emulsions, 0.8 mole % of silver bromide are localized on part of the surfaces of grains containing silver chloride as a base material; Inside the grains and in the silver bromide-localized phase, potassium hexachloroiridate (IV) and potassium ferrocyanide were added in amounts of 0.1 mg and 1.0 mg in total, respectively.)

Gelatin 1.45
Magenta Coupler (ExM) 0.16
Ultraviolet Absorber (UV-2) 0.16
Color Image Stabilizer (Cpd-2) 0.03
Color Image Stabilizer (Cpd-5) 0.10
Color Image Stabilizer (Cpd-6) 0.01
Color Image Stabilizer (Cpd-7) 0.08
Color Image Stabilizer (Cpd-8) 0.01
Color Image Stabilizer (Cpd-10) 0.02
Solvent (Solv-3) 0.13
Solvent (Solv-4) 0.39
Solvent (Solv-6) 0.26

The Fourth Layer (Color Mixture Prevention Layer):

Gelatin 0.68
Color Mixture Preventive (Cpd-4) 0.06
Solvent (Solv-1) 0.07
Solvent (Solv-2) 0.11
Solvent (Solv-3) 0.18
Solvent (Solv-8) 0.02

The Fifth Layer (Red Sensitive Emulsion Layer):

Silver Chlorobromide Emulsion R-101L (aforesaid) 0.09
Silver Chlorobromide Emulsion R-101S (aforesaid) 0.08
Gelatin 0.80
Cyan Coupler (ExC) 0.33
Ultraviolet Absorber (UV-2) 0.18
Color Image Stabilizer (Cpd-1) 0.33
Color Image Stabilizer (Cpd-2) 0.03
Color Image Stabilizer (Cpd-6) 0.01
Color Image Stabilizer (Cpd-8) 0.01
Color Image Stabilizer (Cpd-9) 0.02
Color Image Stabilizer (Cpd-10) 0.01
Solvent (Solv-1) 0.01
Solvent (Solv-7) 0.22

The Sixth Layer (Ultraviolet Absorbing Layer):

Gelatin 0.48
Ultraviolet Absorber (UV-1) 0.38
Fluorescent Whitening Agent (UVX) 0.10
Color Image Stabilizer (Cpd-5) 0.01
Color Image Stabilizer (Cpd-7) 0.05
Solvent (Solv-9) 0.05

The Seventh Layer (Protective Layer):

Gelatin 0.90
Acryl-Modified Copolymer of Polyvinyl Alcohol (Degree of Modification 17%) 0.05
Liquid Paraffin 0.02
Color Image Stabilizer (Cpd-11) 0.01

Yellow Coupler (ExY): an 1:1 (molar ratio) mixture of the following compounds

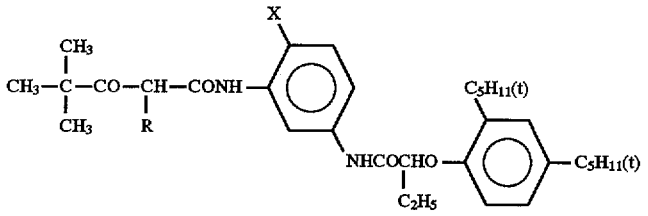

R =

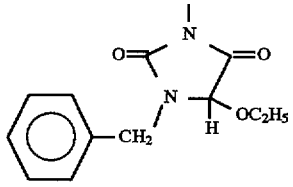

X = Cl and

-continued
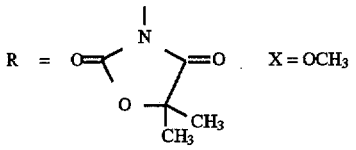
Magenta Coupler (ExM): an 1:1 (molar ratio) mixture of the following compounds
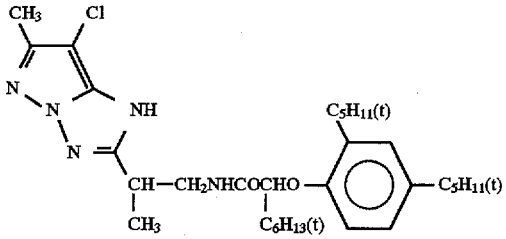
and
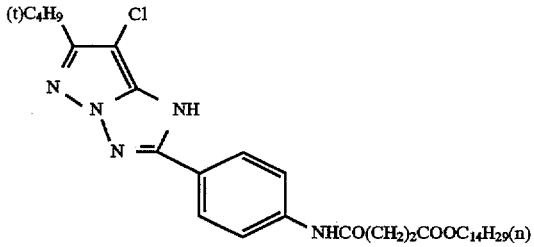
Cyan Coupler (ExC): an 25:75 (molar ratio) mixture of the following compounds
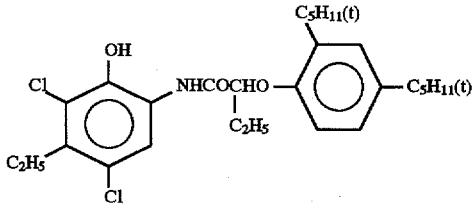
and
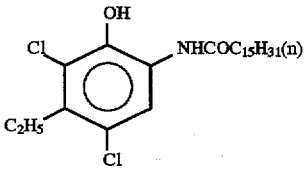
Color Image Stabilizer (Cpd-1): number Average molecular weight 60,000
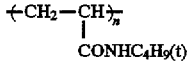
Color Image Stabilizer (Cpd-2):
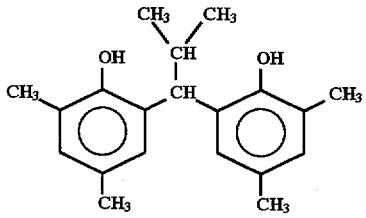
Color Image Stabilizer (Cpd-3): n = 7 or 8 (as an average value)
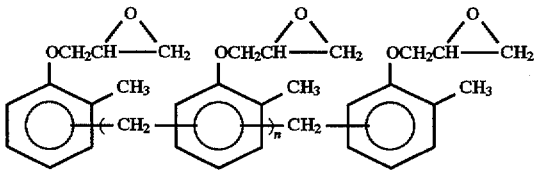

-continued

Color Mixture Preventive (Cpd-4): an 1:1:1 (weight ratio) mixture of the following compounds

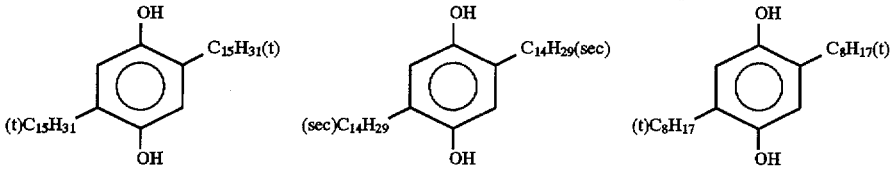

Color Image Stabilizer (Cpd-5):

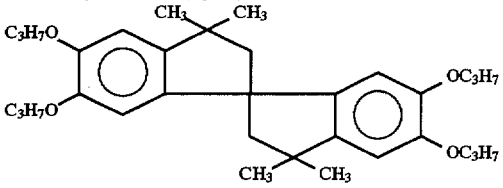

Color Image Stabilizer (Cpd-6):

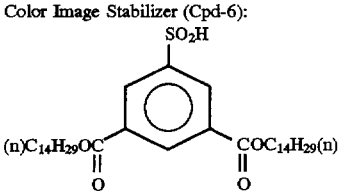

Color Image Stabilizer (Cpd-7): number average molecular weight 600

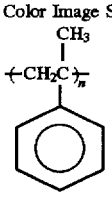

Color Image Stabilizer (Cpd-8):

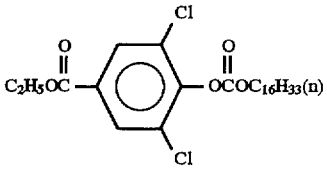

Color Image Stabilizer (Cpd-9):

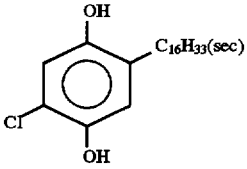

Color Image Stabilizer (Cpd-10):

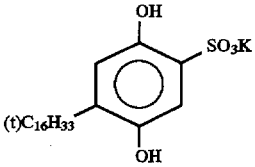

Color Image Stabilizer (Cpd-11): an 1:2:1 (weight ratio) mixture of the following compounds i to iii i)

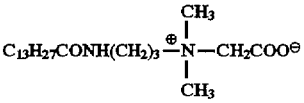

ii)

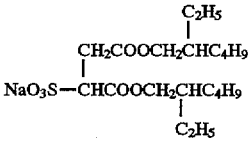

iii)

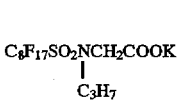

-continued
Preservative (Cpd-12):
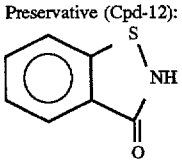
Preservative (Cpd-13):
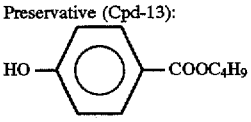
Ultraviolet Absorber (UV-1): an 1:2:2:3:1 (weight ratio) mixture of the following compounds iv to viii
(iv)
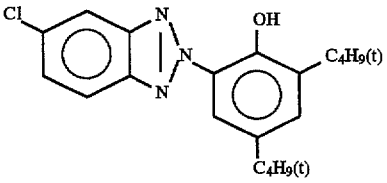
(v)
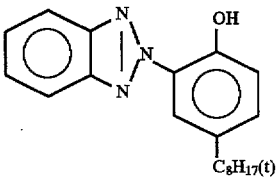
(vi)
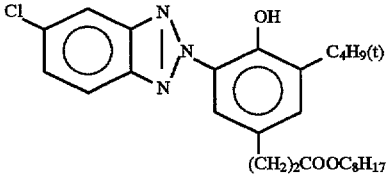
(vii)
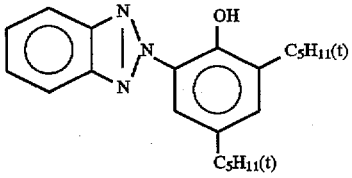
(viii)
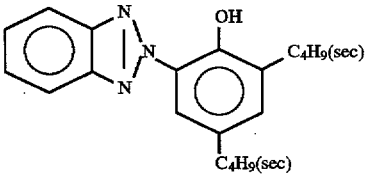
Ultraviolet Absorber (UV-2): a 2:3:4:1 (weight ratio) mixture of the following compounds ix to xii
(ix)
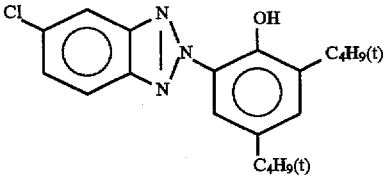
(x)
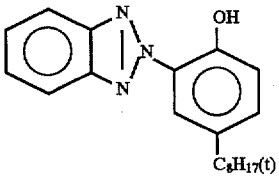
(xi)
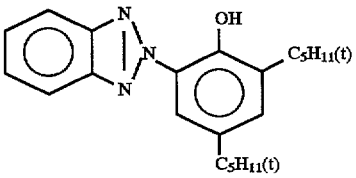
(xii)
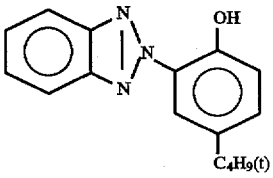
Solvent (Solv-1):
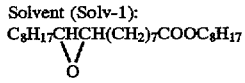
Solvent (Solv-2):
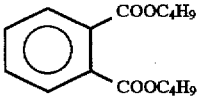

-continued

Solvent (Solv-3):

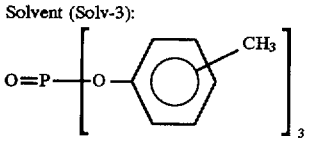

Solvent (Solv-4):

$O{=}P{+}O{-}C_6H_{13}(n)]_3$

Solvent (Solv-5):

$O{=}P{+}OCH_2CHC_4H_9(n)]_3$ ($C_2H_5$)

Solvent (Solv-6):

$(COOC_4H_9)_2(CH_2)_8$

Solvent (Solv-7):

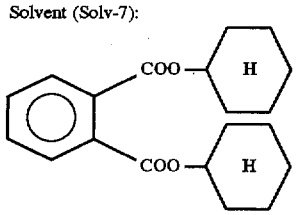

Solvent (Solv-8):

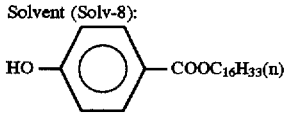

Solvent (Solv-9):

$(COOC_8H_{17})_2(CH_2)_8$

Fluorescent Whitening Agent (UVX):

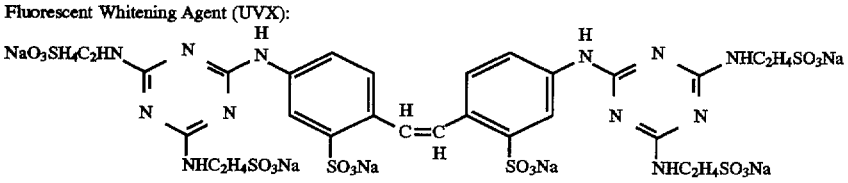

As irradiation neutralizing water-soluble dyes, the following compounds were added to the sixth layer.

Magenta Dyes: The coating amounts of the following dyes were 2 and 20 mg/m$^2$, respectively.

Magenta Dyes: The coating amounts of the following dyes were 2 and 20 mg/m$^2$, respectively.

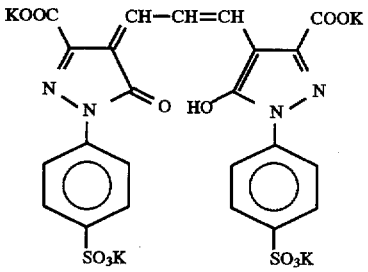

(2 mg/m$^2$)

-continued and

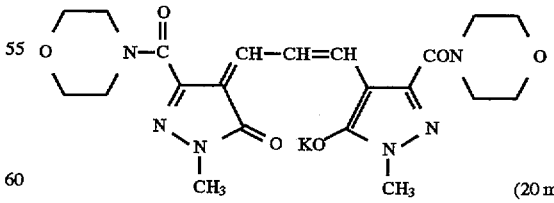

(20 mg/m$^2$)

-continued

Yellow Dye: The coating amount was 10 mg/m$^2$.

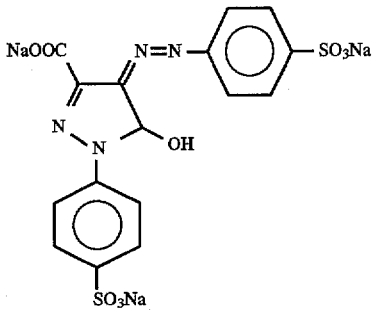

(10 mg/m$^2$)

Samples were prepared similarly to sample 101 thus prepared, except that the emulsions for the fifth layer were sensitized by chemical sensitizers shown in Table 7 and the compounds of the present invention shown in Table 7 were added to the sixth layer. (The compounds added do not remain in the layers to which the compounds are added, but almost uniformly diffuse into all layers on coating.)

Comparative Compound (X):

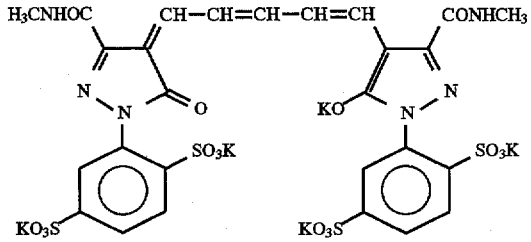

Comparative Compound (Y):

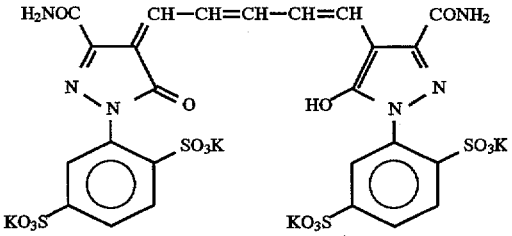

TABLE 7

| Sample | Chemical Sensitizer for the Fifth Layer | Oxonol Compound: Compound | Oxonol Compound: Coating Amount (mole/m$^2$) | Relative Sensitivity | Change in Cyan Density | Coloring of White Background | Note |
|---|---|---|---|---|---|---|---|
| 101 | Triethyl-thiourea (δ) | — | — | 0.00 (standard) | 1.01 | 0.000 | CE*1 |
| 102 | Triethyl-thiourea (δ) | CC(X)*3 | $3 \times 10^{-5}$ | −0.15 | 1.01 | 0.008 | CE |
| 103 | α-1 | — | — | 0.45 | 1.17 | 0.000 | CE |
| 104 | " | CC(X) | $3 \times 10^{-5}$ | 0.30 | 1.06 | 0.008 | CE |
| 105 | " | CC(X) | $6 \times 10^{-5}$ | 0.15 | 1.03 | 0.016 | CE |
| 106 | " | D-22 | $3 \times 10^{-5}$ | 0.31 | 1.05 | 0.002 | PI*2 |
| 107 | " | " | $6 \times 10^{-5}$ | 0.16 | 1.03 | 0.004 | PI |
| 108 | α-1 + δ | " | $3 \times 10^{-5}$ | 0.33 | 1.05 | 0.002 | PI |
| 109 | " | " | $6 \times 10^{-5}$ | 0.18 | 1.03 | 0.004 | PI |
| 110 | α-2 | " | $3 \times 10^{-5}$ | 0.30 | 1.05 | 0.002 | PI |
| 111 | " | " | $6 \times 10^{-5}$ | 0.15 | 1.03 | 0.004 | PI |
| 112 | β-1 | " | $3 \times 10^{-5}$ | 0.33 | 1.04 | 0.002 | PI |
| 113 | β-2 | D-22 | $3 \times 10^{-5}$ | 0.32 | 1.04 | 0.002 | PI |
| 114 | γ-1 | " | " | 0.31 | 1.04 | 0.002 | PI |
| 115 | γ-2 | " | " | 0.32 | 1.04 | 0.002 | PI |
| 116 | α-1 | D-24 | " | 0.33 | 1.05 | 0.003 | PI |
| 117 | " | D-25 | " | 0.33 | 1.05 | 0.003 | PI |
| 118 | " | D-4 | " | 0.33 | 1.06 | 0.004 | PI |
| 119 | " | D-31 | " | 0.33 | 1.06 | 0.004 | PI |
| 120 | " | D-40 | " | 0.33 | 1.06 | 0.004 | PI |
| 121 | " | D-8 | " | 0.33 | 1.06 | 0.004 | PI |
| 122 | " | CC(Y)*4 | " | 0.29 | 1.06 | 0.008 | CE |

*1CE = Comparative Example
*2PI = Present Invention
*3CC(X) = Comparative Compound (X)
*4CC(Y) = Comparative Compound (Y)

After the samples thus prepared were subjected to hardening reaction, they were evaluated in the following manner. To examine the fluctuation in color forming density depending on time elapsing from exposure until development when the samples were exposed to light under the circumstances of high humidity, the samples were exposed to light at 25° C.–85% RH through color separation filters and a gradation wedge by use of a sensitometer (FWH type, manufactured by Fuji Photo Film Co., Ltd., color temperature of the light source 3,200K), allowed to stand for 1 minute or 30 minute, and processed as described below:

| Processing Steps | Temperature (°C.) | Time (sec) | Replenishment Rate* (ml) | Tank Capacity (ml) |
|---|---|---|---|---|
| Color Development | 38.5 | 45 | 73 | 500 |
| Bleach-Fix | 30 to 35 | 45 | 60 | |
| Rinse 1 | 30 to 35 | 20 | | |
| Rinse 2 | 30 to 35 | 20 | | |
| Rinse 3 | 30 to 35 | 20 | | |
| Drying | 70 to 80 | 60 | | |

*replenishment rate per $m^2$ of the samples Rinses were conducted by a three-tank countercurrent system of Rinse 3 to Rinse 1

The compositions of the processing solutions were as follows:

| Tank Developer: | Tank Solution | Replenisher |
|---|---|---|
| Water | 700 ml | 700 ml |
| Sodium Triisopropylene(β)sulfonate | 0.1 g | 0.1 g |
| Ethylenediaminetetraacetic acid | 3.0 g | 3.0 g |
| Disodium 1,2-Dihydroxybenzene-4,6-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Fluorescent Whitening Agent (WHITEX 4, Manufactured by Sumitomo Chemical Co., Ltd.) | 1.0 g | 3.0 g |
| Sodium Sulfite | 0.1 g | 0.1 g |
| Disodium-N,N-bis(sulfonatoethyl)-hydroxylamine | 10.0 g | 13.0 g |
| N-ethyl-N-(β-methanesulfonamido-ethyl)-3-methyl-4-aminoaniline Sulfate | 5.0 g | 11.5 g |
| With Water | to 1,000 ml | to 1,000 ml |
| pH (25° C.) | 10.0 | 11.0 |

Bleach-Fix Bath: (The tank solution and the replenisher have the same composition)

Water 600 ml

Ammonium Thiosulfate (700 g/liter) 100 ml

Ammonium Sulfite 40 g

Iron (III) Ammonium Ethylenediaminetetraacetate 55 g

Disodium Ethylenediaminetetraacetic Acid 5 g

Ammonium Bromide 40 g

Nitric Acid (67%) 30 g

With Water to 1,000 ml pH (adjusted with acetic acid and aqueous ammonia) 5.8

Rinse: (The tank solution and the replenisher have the same composition)

Ion-Exchanged Water (The contents of calcium and magnesium were 3 ppm or less, respectively)

The cyan reflection density of the samples thus processed was measured to obtain characteristic curves. Sensitivity was defined as the logarithm of the reciprocal of exposure amount giving 0.5 higher density than fog density of the characteristic curves, and shown in Table 7 by relative values based on the sensitivity of sample 101 which was assumed to be 0.00. The cyan density of the samples processed after an elapse of 30 minutes after exposure was conducted in exposure amount giving cyan density 1.0 in the samples processed after an elapse of 1 minute after exposure was shown in Table 7 as a measure of fluctuation in density.

To evaluate the coloring of the white background, the cyan density of the white portions of the above-mentioned samples was determined by use of X-RITE 310 manufactured by X-RITE Co., Ltd., and subsequently, after said white portions were washed with pure water maintained at 40° C. for 20 minutes, the cyan density was similarly determined. Difference in density before and after washing was shown in Table 7 as a measure of the coloring.

As shown in Table 7, when chemical sensitization was conducted by use of triethylthiourea, long time elapsing from exposure until development when the samples were exposed to light under the circumstances of high humidity results in a small fluctuation in color forming density, whereas it unpreferably causes the sensitivity to lower (samples 101 and 102). Use of chemical sensitizers of the present invention brings about high sensitivity, but when the oxonol compounds were not used, long time elapsing from exposure until processing unpreferably causes a large fluctuation in color forming density (sample 103). Further, when oxonol compounds of comparative compounds were used, long time elapsing from exposure until processing reduces the fluctuation in color forming density. However, the long time elapsing unpreferably lowers the sensitivity and increase coloring of the background (samples 104, 105 and 122). On the contrary, the structure of the present invention provides the photographic material which exhibits high sensitivity, a small fluctuation in density despite long time elapsing from exposure until development when the photographic material is exposed to light under the circumstances of high humidity, and low coloring of the background (samples 106 to 121).

EXAMPLE 2

The photographic materials prepared in Example 1 were similarly processed and evaluated except that they were subjected to the following exposure. Similar results to those of Example 1 were obtained.

Exposure:

Light sources used are 473 nm taken out by wave changing of a YAG solid state laser (oscillating wavelength 946 nm) using semiconductor laser GaA1As (oscillating wavelength 808.5 nm) as an excitation source by use of the SHG crystal of $KNbO_3$; 532 nm taken out by wave changing of a $YVO_4$ solid state laser (oscillating wavelength 1064 nm) using semiconductor laser GaAlAs (oscillating wavelength 808.7 nm) as an excitation source by use of the SHG crystal of KTP; and AlGaInP (oscillating wavelength about 670 nm, Type No. TOLD 9211 manufactured by Toshiba Corp.). In a scanning exposure device, exposure is carried out by exposing color photographic printing paper moving in the vertical direction to the scanning direction of a laser by a rotating polygon. By use of the device, the relationship between the density (D) of the photographic materials-and quantity of light (E), D—log E, was determined by changing the quantity of light. Then, in the lasers having 3 different wavelengths, the quantity of light was modulated with the aid of an external modulator to control the exposure amount. The scanning exposure was carried out at 400 dpi, and the average exposure time per pixel was about $5\times10^{-8}$ second. To inhibit a change in quantity of light owing to temperature, the semiconductor laser was maintained at a constant temperature by use of a Peltier element.

Thus, the present invention can provide a silver halide color photographic material which exhibits excellent sharpness, excellently rapid processing performance, high sensitivity, a high purity whiteness in the white background of a finished color photograph, and a small fluctuation in color forming density despite time elapsing from exposure until development when the color photographic material is exposed under the circumstances of high humidity.

It should further be apparent to those skilled in the art that various changes in form and detail of the invention as shown and described above may be made. It is intended that such changes be inclined with in the spirit and scope of the claimed appended hereto.

What is claimed is:

1. A silver halide color photographic material comprising a support having provided thereon photographic constituent layers comprising (i) at least three kinds of silver halide emulsion layers different in color sensitivity, each containing a yellow color-forming coupler, a magenta color-forming coupler and a cyan color-forming coupler, respectively, and (ii) at least one light-insensitive layer, wherein the photographic constituent layers comprises at least one layer containing silver chloride grains or silver chlorobromide grains having a silver chloride content of not less than 90 mol %, the silver chloride grains or silver chlorobromide grains having a silver chloride content of not less than 90 mol % being sensitized by at least one compound selected from the group consisting of a gold compound, a selenium compound and a tellurium compound; and the photographic constituent layers comprises at least one layer containing at least one compound represented by formula (I)

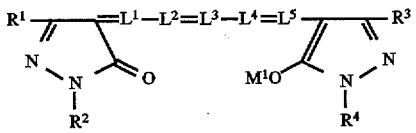

(I)

wherein $R^1$ and $R^3$ each represents an electron withdrawing group having a Hammett substituent constant $\sigma_p$ of 0.3 or more; $R^2$ and $R^4$ each represents an alkyl group or an aryl group; $L^1$ to $L^5$ each represents a methine group, with the proviso that at least one of $L^1$ to $L^5$ has a substituent group; $M^1$ represents a hydrogen atom, or an atomic group or metal atom to be a monovalent cation.

2. The silver halide color photographic material as claimed in claim 1, wherein $R^1$ and $R^3$ each represents an electron withdrawing group having a Hammett substituent constant $\sigma_p$ of 0.3 to 0.8.

3. The silver halide color photographic material as claimed in claim 1, wherein $R^1$ and $R^3$ each represents a carboxyl group, an alkoxycarbonyl group, an acyl group or a carbamoyl group.

4. The silver halide color photographic material as claimed in claim 1, wherein $R^1$ and $R^3$ each represents an alkoxycarbonyl group or a carbamoyl group.

5. The silver halide color photographic material as claimed in claim 1, wherein $R^2$ and $R^4$ each represents an alkyl group which has 1 to 8 carbon atoms and which is substituted with at least one sulfo group.

6. The silver halide color photographic material as claimed in claim 1, wherein $R^2$ and $R^4$ each represents an aryl group which has 6 to 10 carbon atoms and which is substituted with at least one sulfo group.

7. The silver halide color photographic material as claimed in claim 1, wherein $R^2$ and $R^4$ each represents a phenyl group substituted with at least two sulfo groups.

8. The silver halide color photographic material as claimed in claim 1, wherein the substituent group on the methine group represented by $L^1$, $L^2$, $L^3$, $L^4$ or $L^5$ is an alkyl group having 1 to 8 carbon atoms, which may be substituted; an alkoxy group having 1 to 6 carbon atoms, which may be substituted; an alkylthio group having 1 to 6 carbon atoms, which may be substituted; an arylthio group having 1 to 10 carbon atoms, which may be substituted; an amino group having 0 to 8 carbon atoms, which may be substituted; a heterocyclic group, which may be substituted; a halogen atom; a hydroxyl group; a carbonyl group; a sulfo group; or a cyano group.

9. The silver halide color photographic material as claimed in claim 1, wherein the at least one compound represented by formula (I) is represented by formula (II)

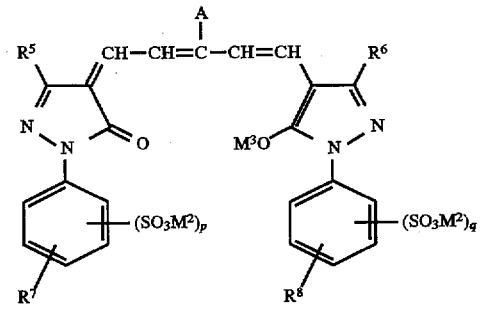

(II)

wherein $R^5$ and $R^6$ each represents an electron withdrawing group having a Hammett substituent constant $\theta_p$ of 0.3 to 0.6; $R^7$ and $R^8$ each represents a hydrogen atom, a halogen atom, a hydroxyl group, a methyl group or methoxy group; A represents an alkyl group having 1 to 8 carbon atoms or an aryl group having 6 to 10 carbon atoms; $M^2$ and $M^3$ each has the same meaning as $M^1$; and p and q each represents an integer of 2 to 5.

10. The silver halide color photographic material as claimed in claim 9, wherein $R^5$ and $R^6$ each represents an alkoxycarbonyl group or a carbamoyl group.

11. The silver halide color photographic material as claimed in claim 9, wherein $R^7$ and $R^8$ each represents a hydrogen atom or a methyl group.

12. The silver halide color photographic material as claimed in claim 9, wherein A represents a substituted or unsubstituted alkyl group having 1 to 4 carbon atoms.

13. The silver halide color photographic material as claimed in claim 9, wherein at least one of plural $SO_3M^1$ and $SO_3M^2$ on the phenyl rings of formula (II) is attached to the ortho position to the pyrazolone ring of formula (II).

14. The silver halide color photographic material as claimed in claim 1, wherein the at least one compound represented by formula (I) is coated in an amount of 0.1 $mg/m^2$ to 200 $mg/m^2$.

15. A method for forming a color image, which comprises exposing a silver halide photographic material to light by a scanning exposure system taking a shorter exposure time than $10^{-4}$ second per pixel to prepare an exposed image, and color developing the exposed image;

wherein the silver halide color photographic material comprises a support having provided thereon photographic constituent layers comprising (i) at least three kinds of silver halide emulsion layers different in color sensitivity, each containing a yellow color-forming coupler, a magenta color-forming coupler and a cyan color-forming coupler, respectively, and (ii) at least one light-insensitive layer, wherein the photographic constituent layers comprises at least one layer containing silver chloride grains or silver chlorobromide grains having a silver chloride content of not less than 90 mol %, the silver chloride grains or silver chlorobromide grains having a silver chloride content of not less than 90 mol % being sensitized by at least one compound selected from the group consisting of a gold compound, a selenium compound and a tellurium compound; and the photographic constituent layers comprises at least one layer containing at least one compound represented by formula (I)

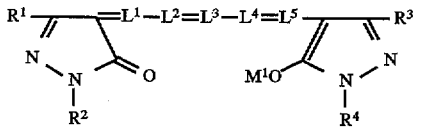

(I)

wherein $R^1$ and $R^3$ each represents an electron withdrawing group having a Hammett substituent constant $\theta_p$ of 0.3 or more; $R^2$ and $R^4$ each represents an alkyl group or an aryl group; $L^1$ to $L^5$ each represents a methine group, with the proviso that at least one of $L^1$ to $L^5$ has a substituent group; $M^1$ represents a hydrogen atom, or an atomic group or metal atom to be a monovalent cation.

* * * * *